US010831128B2

(12) United States Patent
Ishida et al.

(10) Patent No.: US 10,831,128 B2
(45) Date of Patent: Nov. 10, 2020

(54) IMAGE FORMING APPARATUS HAVING IMAGE FORMATION INTERRUPTION

(71) Applicant: CANON KABUSHIKI KAISHA, Tokyo (JP)

(72) Inventors: Yusuke Ishida, Toride (JP); Takanori Iida, Noda (JP); Masashi Wakisaka, Misato (JP); Katsuya Nose, Kashiwa (JP); Yuta Okuyama, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/281,288

(22) Filed: Feb. 21, 2019

(65) Prior Publication Data

US 2019/0265612 A1 Aug. 29, 2019

(30) Foreign Application Priority Data

Feb. 28, 2018 (JP) ..... 2018-035074

(51) Int. Cl.
*G03G 15/08* (2006.01)
*G03G 15/00* (2006.01)

(52) U.S. Cl.
CPC ..... *G03G 15/0858* (2013.01); *G03G 15/0851* (2013.01); *G03G 15/0853* (2013.01); *G03G 15/0881* (2013.01); *G03G 15/0891* (2013.01); *G03G 15/0898* (2013.01); *G03G 15/5054* (2013.01); *G03G 15/556* (2013.01); *G03G 15/0893* (2013.01)

(58) Field of Classification Search
CPC ..... G03G 15/0891; G03G 15/0887
See application file for complete search history.

(56) References Cited

U.S. PATENT DOCUMENTS

| | | | | |
|---|---|---|---|---|
| 7,010,237 | B2 | 3/2006 | Suzuki et al. | |
| 7,027,746 | B2 | 4/2006 | Suzuki et al. | |
| 7,512,348 | B2 | 3/2009 | Suzuki et al. | |
| 7,536,120 | B2 | 5/2009 | Ishida | |
| 2011/0176839 | A1* | 7/2011 | Gonda | G03G 15/0887 399/263 |

(Continued)

FOREIGN PATENT DOCUMENTS

| | | | |
|---|---|---|---|
| JP | S59-100471 | A | 6/1984 |
| JP | 2011-053632 | A | 3/2011 |

*Primary Examiner* — Sandra Brase
(74) *Attorney, Agent, or Firm* — Venable LLP

(57) ABSTRACT

An image forming apparatus includes a control portion, and in a first period from when use of a developing apparatus is started until when an amount of developer in a developing device reaches a predetermined amount larger than an amount of initial developer, when an amount of developer supplied from a supplying portion through a single supplying operation in an image forming operation is larger than a predetermined supplied amount, the control portion interrupts the image forming operation and drives a conveyance portion for a predetermined time. In a second period after the amount of the developer reaches the predetermined amount, when an amount of the supplying developer supplied through a single supplying operation in the image forming operation is larger than the predetermined supplied amount, the control portion continues the image forming operation without interruption.

4 Claims, 32 Drawing Sheets

(56) References Cited

U.S. PATENT DOCUMENTS

| | | | | |
|---|---|---|---|---|
| 2013/0084106 | A1* | 4/2013 | Tsuda | G03G 15/0891 399/258 |
| 2016/0170327 | A1* | 6/2016 | Saito | G03G 15/0856 399/27 |

* cited by examiner

IMAGE FORMING APPARATUS HAVING IMAGE FORMATION INTERRUPTION

BACKGROUND OF THE INVENTION

Field of the Invention

The present invention relates to image forming apparatuses such as copying machines, printers, facsimiles, and multifunction printers having a plurality of functions of these products.

Description of the Related Art

Developing apparatuses used for image forming apparatuses use two-component developer containing toner and carrier. In Japanese Patent Application Publication No. S59-100471, such a developing apparatus discharges excess developer, and is supplied with toner by the amount of toner consumed for forming images.

In addition, Japanese Patent Application Publication No. 2011-53632 proposes a technique which counts the number of sheets on which an image has been formed since a new developing apparatus was attached to an image forming apparatus, sets an exposure amount in accordance with the number of the image-formed sheets, and thereby suppresses change in image density when the developing apparatus is used.

The change in image density may be caused by the amount of developer contained in the developing apparatus. For example, when the amount of initial developer of a new developing apparatus is small, the amount of carrier of the developing apparatus is also small. Thus, when toner is supplied, the supplied toner may not be sufficiently charged, causing unstable images. Such a problem is required to be solved.

SUMMARY OF THE INVENTION

An object of the present invention is to provide a configuration which increase the stability of images even when the amount of initial developer of a developing apparatus is small.

According to a first aspect of the present invention, an image forming apparatus includes an image bearing member, a developing apparatus configured to contain developer containing toner and carrier, and develop an electrostatic latent image formed on the image bearing member, by using the toner, the developer being enclosed in the developing apparatus by a seal member before use of the developing apparatus is started, the developing apparatus comprising an outlet configured to discharge the developer of the developing apparatus, a developer supplying container configured to contain supplying developer to be supplied to the developing apparatus, a supplying portion configured to supply the supplying developer from the developer supplying container to the developing apparatus, a density detecting portion configured to detect a density of a control toner image formed by the developing apparatus, the control toner image is formed every time when an image is formed on a predetermined number of sheets in successively forming the image on sheets, and a control portion configured to control an amount of supplying developer supplied by the supplying portion, in accordance with a detection result by the density detecting portion. The control portion controls forming of the control toner image so that the predetermined number of image-formed sheets is a first number of image-formed sheets in a period of time from when the use of the developing apparatus is started, until when an amount of developer of the developing apparatus reaches a set value which is larger than an amount of initial developer of the developing apparatus obtained before the developing apparatus is used, and the predetermined number of image-formed sheets is a second number of image-formed sheets which is larger than the first number of image-formed images, after the amount of developer of the developing apparatus reaches the set value.

According to a second aspect of the present invention, an image forming apparatus includes an image bearing member, a developing apparatus configured to contain developer containing toner and carrier, and develop an electrostatic latent image formed on the image bearing member, by using the toner, the developer being enclosed in the developing apparatus by a seal member before use of the developing apparatus is started, the developing apparatus comprising an outlet configured to discharge the developer of the developing apparatus, an exposure portion configured to expose the image bearing member and form the electrostatic latent image, a developer supplying container configured to contain supplying developer to be supplied to the developing apparatus, a supplying portion configured to supply the supplying developer from the developer supplying container to the developing apparatus, a density detecting portion configured to detect a density of a control toner image formed by the developing apparatus, the control toner image is formed every time when an image is formed on a predetermined number of sheets in successively forming the image on sheets, a setting portion configured to set an amount of exposure performed by a laser beam emitted from the exposure portion, the setting portion setting the amount of exposure, depending on a detection result by the density detecting portion, and a control portion configured to control forming of the control toner image so that the predetermined number of image-formed sheets is a first number of image-formed sheets in a period of time from when the use of the developing apparatus is started, until when an amount of developer of the developing apparatus reaches a set value which is larger than an amount of initial developer of the developing apparatus obtained before the developing apparatus is used, and the predetermined number of image-formed sheets is a second number of image-formed sheets which is larger than the first number of image-formed images, after the amount of developer of the developing apparatus reaches the set value.

According to a third aspect of the present invention, an image forming apparatus includes an image bearing member, a developing apparatus configured to contain developer containing toner and carrier, and develop an electrostatic latent image formed on the image bearing member, by using the toner, the developer being enclosed in the developing apparatus by a seal member before use of the developing apparatus is started, the developing apparatus comprising an outlet configured to discharge the developer of the developing apparatus, a developer bearing member disposed in the developing apparatus and configured to bear and convey the developer, a developer supplying container configured to contain supplying developer to be supplied to the developing apparatus, a supplying portion configured to supply the supplying developer from the developer supplying container to the developing apparatus, and a discharging control portion configured to control execution of discharging operation to discharge the developer from the image bearing member if an image having a low image ratio smaller than a predetermined value is successively formed on sheets such that a number of image-formed sheets in a period from an execution of one discharging operation to an execution of a following discharging operation is a first number of image-formed sheets during from when use of the developing apparatus is started, until when an amount of developer of the developing apparatus reaches a first developer amount which is larger than an amount of initial developer of the developing apparatus obtained before the developing apparatus is used, and a number of image-formed sheets in a period from an execution of one discharging operation to an execution of a following discharging operation is a second number of image-formed sheets larger than the first number of image-formed sheets, when the amount of developer of the developing apparatus is a second developer amount larger than the first developer amount after reaching the first developer amount.

According to a fourth aspect of the present invention, an image forming apparatus includes an image bearing member, a developing apparatus configured to contain developer containing toner and carrier, and develop an electrostatic latent image formed on the image bearing member, by using the toner, the developer being enclosed in the developing apparatus by a seal member before use of the developing apparatus is started, the developing apparatus comprising an outlet configured to discharge the developer of the developing apparatus, a developer bearing member disposed in the developing apparatus and configured to bear and convey the developer, a developer supplying container configured to contain supplying developer to be supplied to the developing apparatus, a supplying portion configured to supply the supplying developer from the developer supplying container to the developing apparatus, and a discharging control portion configured to control a discharging operation to discharge the developer from the developer bearing member if an image having a low image ratio smaller than a predetermined value is successively formed on sheets such that an amount of discharged developer in the discharging operation is a first discharged amount in a period of time from when the use of the developing apparatus is started, until when an amount of developer of the developing apparatus reaches a first developer amount which is larger than an amount of initial developer of the developing apparatus obtained before the developing apparatus is used, and the amount of discharged developer in the discharging operation is a second discharged amount smaller than the first discharged amount, when the amount of developer of the developing apparatus is a second developer amount larger than the first developer amount after reaching the first developer amount.

According to a fifth aspect of the present invention, an image forming apparatus includes an image bearing member, a developing apparatus configured to contain developer containing toner and carrier, and develop an electrostatic latent image formed on the image bearing member, by using the toner, the developer being enclosed in the developing apparatus by a seal member before use of the developing apparatus is started, the developing apparatus comprising an outlet configured to discharge the developer of the developing apparatus, a developer bearing member disposed in the developing apparatus and configured to bear and convey the developer, a conveyance portion disposed in the developing apparatus and configured to circulate the developer in the developing apparatus, a developer supplying container configured to contain supplying developer to be supplied to the developing apparatus, a supplying portion configured to supply the supplying developer from the developer supplying container to the developing apparatus, and a control portion configured to stop an image forming operation and drive the conveyance portion for a predetermined time if the supplying developer is supplied by a predetermined amount or more through a single supplying operation in the image forming operation in a period of time from when the use of the developing apparatus is started, until when an amount of developer of the developing apparatus reaches a predetermined amount which is larger than an amount of initial developer obtained before the developing apparatus is used.

Further features of the present invention will become apparent from the following description of exemplary embodiments with reference to the attached drawings.

DESCRIPTION OF THE EMBODIMENTS

First Embodiment

A first embodiment will be described with reference to FIGS. 1 to 15. First, a schematic configuration of an image forming apparatus of the present embodiment will be described with reference to FIGS. 1 and 2.

Image Forming Apparatus

An image forming apparatus 100 is a tandem-type electrophotographic full-color printer. The image forming apparatus 100 includes four image forming portions PY, PM, PC, and PK, each having a photosensitive drum 1 which serves as an image bearing member. The image forming apparatus 100 forms a toner image (image) on a recording material, in accordance with an image signal sent from a document reading apparatus (not illustrated) connected to an apparatus body 100A, or from a host device, such as a personal computer, communicatively connected to the apparatus body 100A. The recording material may be a sheet material, such as a paper sheet, a plastic film, or a cloth sheet. The image forming portions PY, PM, PC, and PK respectively form toner images of yellow, magenta, cyan, and black.

Here, the four image forming portions PY, PM, PC, and PK of the image forming apparatus 100 are substantially the same as each other, except that they have different developing colors from each other. Thus, the image forming portion PK will be described as one example, and the description for the other image forming portions will be omitted.

Figure 2:
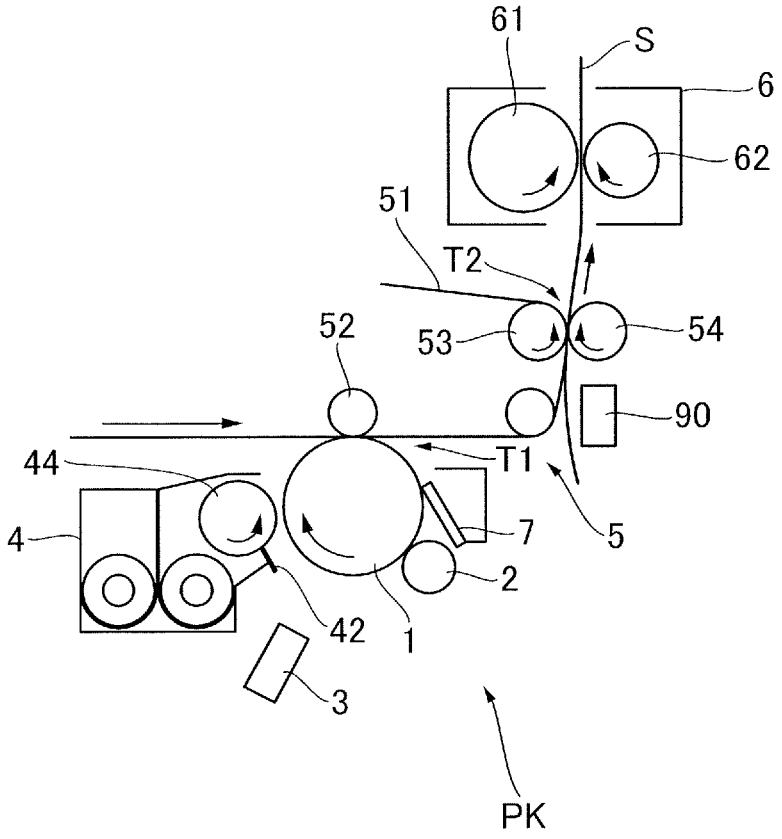
FIG. 2 is a schematic configuration diagram of an image forming portion PK of the first embodiment and its surroundings.

As illustrated in FIG. 2, the image forming portion PK includes a cylindrical photosensitive member, or the photosensitive drum 1 as an image bearing member. The photosensitive drum 1 is rotated in a direction indicated by an arrow of FIG. 2. Around the photosensitive drum 1, there are disposed a charging roller 2 which serves as a charging portion, a developing apparatus 4, a primary transfer roller 52 which serves as a primary transfer portion, and a cleaning apparatus 7 which serves as a cleaning portion. Below the photosensitive drum 1 in FIG. 2, an exposure apparatus 3 (a laser scanner in the present embodiment) is disposed as an exposure portion.

Figure 1:
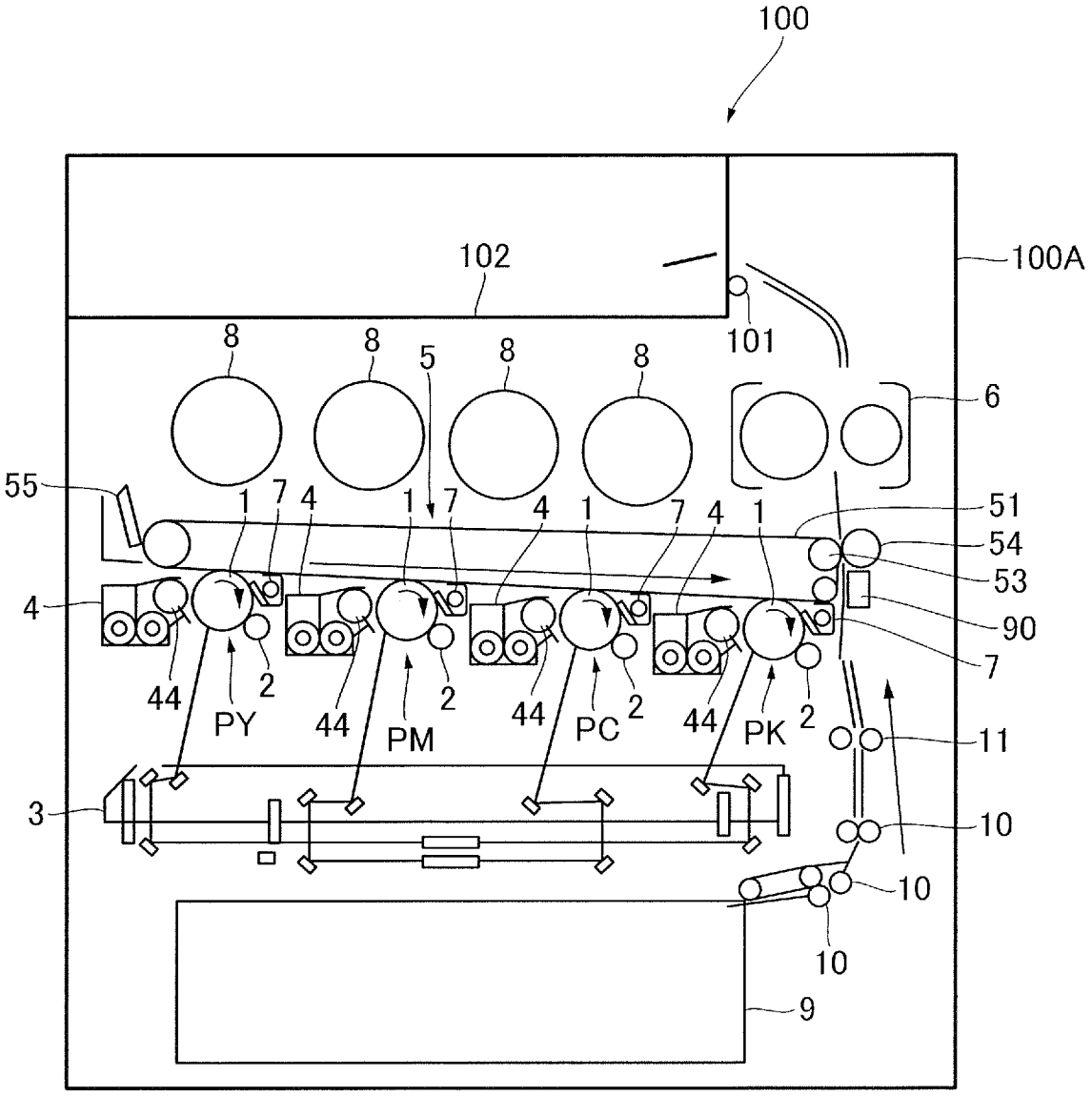
FIG. 1 is a schematic configuration diagram of an image forming apparatus of a first embodiment.

Above the image forming portions in FIG. 1, an intermediate transfer apparatus 5 is disposed as a transfer portion. The intermediate transfer apparatus 5 is configured such that an endless intermediate transfer belt 51, which serves as an intermediate transfer member, is wound around a plurality of rollers, and is revolved (rotated) in a direction indicated by an arrow of FIG. 1. As described later, the intermediate transfer belt 51 carries and conveys a toner image which has been primary-transferred onto the intermediate transfer belt 51. A secondary transfer outer roller 54, which serves as a secondary transfer member, is disposed at a position at which the secondary transfer outer roller 54 faces, via the intermediate transfer belt 51, a secondary transfer inner roller 53 which is one of the rollers, around which the intermediate transfer belt 51 is wound. The secondary transfer outer roller 54 and the secondary transfer inner roller 53 constitute a secondary transfer portion T2, which transfers the toner image formed on the intermediate transfer belt 51, onto the recording material. A fixing apparatus 6 is disposed downstream from the secondary transfer portion T2 in a recording-material conveyance direction.

In a lower portion of the image forming apparatus 100, there is disposed a cassette 9 in which a recording material S is stored. The recording material S is fed from the cassette 9 and conveyed by a conveyance roller 10 toward a registration roller 11. When the leading edge of the recording material S abuts against the registration roller 11 which is in a stop state, a loop is formed, and then skew of the recording material S is corrected. Then the registration roller 11 starts to rotate and conveys the recording material S to the secondary transfer portion T2, in synchronization with the conveyance of the toner image formed on the intermediate transfer belt 51.

Next, an image forming process by the above-described image forming apparatus 100 will be described. Here, the image forming process is performed to create a full-color image having four colors, for example. First, when an image forming operation is started, the surface of the rotating photosensitive drum 1 is uniformly charged by the charging roller 2. The photosensitive drum 1 is then exposed to a laser beam emitted from the exposure apparatus 3 and corresponding to an image signal. With this operation, an electrostatic latent image is formed on the photosensitive drum 1 in accordance with the image signal. The electrostatic latent image on the photosensitive drum 1 is then made visible and becomes a visible image by using toner contained in the developing apparatus 4 and serving as developer.

The toner image formed on the photosensitive drum 1 is then primary-transferred onto the intermediate transfer belt 51 in a primary transfer portion T1 (FIG. 2), constituted by the photosensitive drum 1 and a primary transfer roller 52.

The primary transfer roller 52 is disposed at a position at which the primary transfer roller 52 faces the photosensitive drum 1 via the intermediate transfer belt 51. In this time, the primary transfer roller 52 is being applied with a primary transfer bias. Sticking substance, such as toner (remaining toner) left on the surface of the photosensitive drum 1 after the primary transfer, is removed by a cleaning apparatus 7. With this operation, the photosensitive drum 1 is made ready for the next image forming process.

Such an operation is performed sequentially in the image forming portions of yellow, magenta, cyan, and black; and four-color toner images are superposed on each other on the intermediate transfer belt 51. The recording material S stored in the cassette 9 is conveyed to the secondary transfer portion T2 in synchronization with the formation of the toner image. After that, by applying a secondary transfer bias to the secondary transfer outer roller 54, the four-color toner images on the intermediate transfer belt 51 are collectively secondary-transferred onto the recording material S. Sticking substance, such as toner not used for the secondary transfer in the secondary transfer portion T2 and left on the intermediate transfer belt 51, is removed by an intermediate transfer belt cleaner 55.

Figure 6:
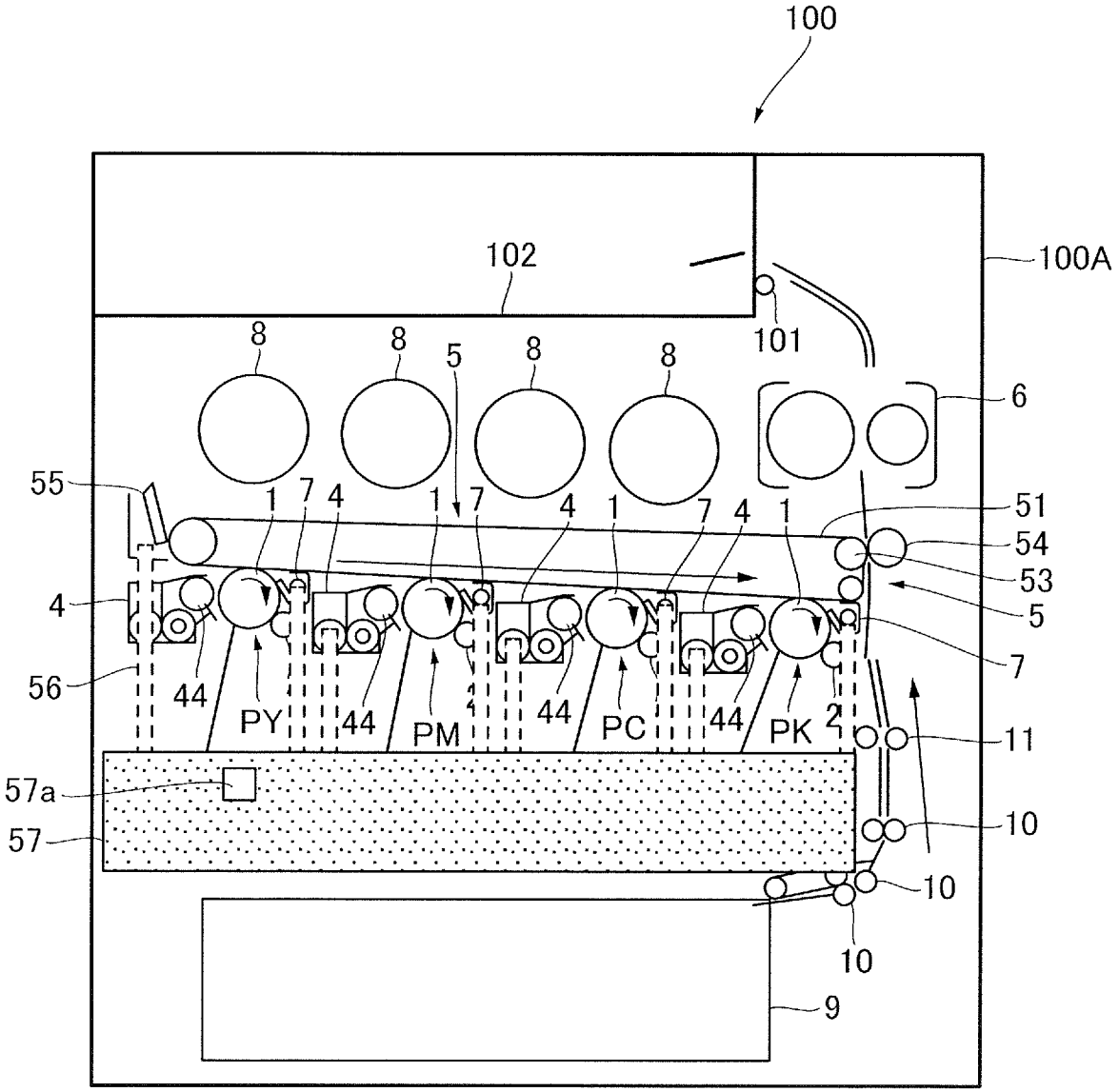
FIG. 6 is a diagram illustrating a toner collection configuration of the first embodiment.

As illustrated in FIG. 6 which will be described later, the sticking substance, such as toner, removed by the cleaning apparatus 7 and the intermediate transfer belt cleaner 55 is conveyed through conveyance pipes 56, and collected in a toner collection box 57. Toner is supplied from a toner container 8 by the amount of toner consumed for forming images.

The recording material S is then conveyed to the fixing apparatus 6 which serves as a fixing portion. The fixing apparatus 6 includes a fixing roller 61 having a heat source such as a halogen heater, and a pressure roller 62. The fixing roller 61 and the pressure roller 62 form a fixing nip portion. When passing through the fixing nip portion of the fixing apparatus 6, the recording material S on which the toner image has been transferred is heated and pressurized. Then the toner on the recording material S is melted and mixed, and fixed to the recording material S as a full-color image. The recording material S is then discharged to a discharging tray 102 by a discharge roller 101. With this operation, a series of image forming processes are completed.

Here, the image forming apparatus 100 of the present embodiment may form a monochrome image by using an image forming portion for a desired monochrome image, such as a black image, or may form a multicolor image by using image forming portions for some of the four colors.

Developing Apparatus

Figure 3:
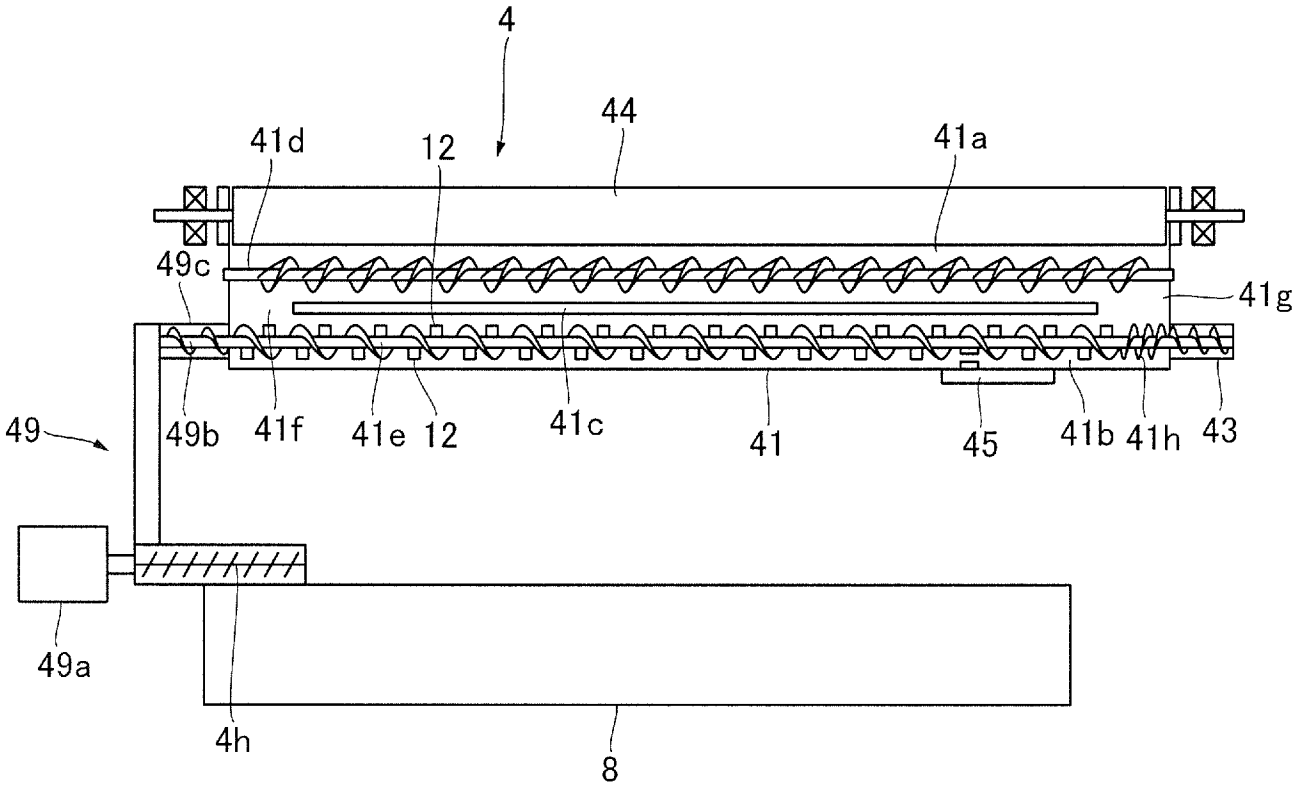
FIG. 3 is a schematic configuration diagram of a developing apparatus and a supplying apparatus of the first embodiment.
Figure 4:
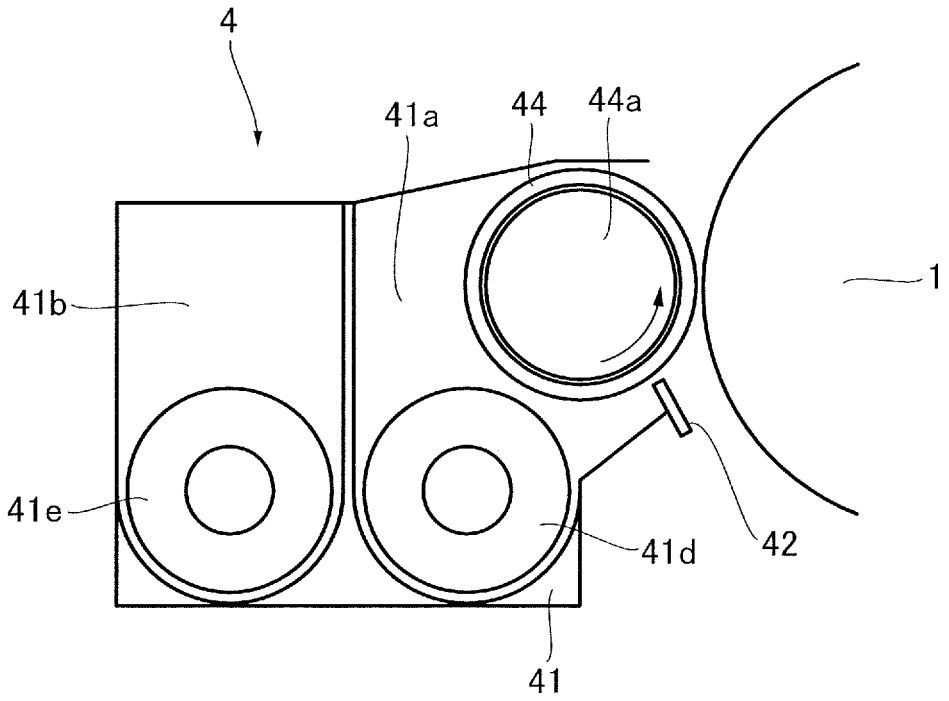
FIG. 4 is a schematic cross-sectional view of the developing apparatus of the first embodiment.

Next, with reference to FIGS. 3 and 4, the developing apparatus 4 will be further described. The developing apparatus 4 includes a developer container 41 which contains two-component developer containing nonmagnetic toner and magnetic carrier. The developer container 41 includes a developing sleeve 44 which serves as a developer bearing member and a magnet roll 44*a* disposed in and fixed to the developing sleeve 44. The magnet roll 44*a* is a magnet which serves as a magnetic-field generating portion. In addition, the developer container 41 includes a developing blade 42 and agitating-and-conveying screws 41*d* and 41*e*. The developing blade 42 serves as a developer regulation member and forms a thin layer of developer on the surface of the developing sleeve 44. The agitating-and-conveying screws 41*d* and 41*e* serve as conveyance portions and convey the developer of the developer container 41 while agitating the same.

The interior of the developer container 41 is partitioned into a developing chamber 41*a* which is a first chamber and an agitating chamber 41*b* which is a second chamber, by a partition wall 41*c* extending in a vertical direction. The agitating-and-conveying screw 41*d* is disposed in the developing chamber 41*a*, and the agitating-and-conveying screw 41*e* is disposed in the agitating chamber 41*b*. In both edge portions (located on the right side and the left side in FIG. 3) of the partition wall 41*c* in the longitudinal direction (i.e. direction parallel to a direction in which the developer is conveyed by the agitating-and-conveying screw 41*d*, or to a direction in which the developer is conveyed by the agitating-and-conveying screw 41*e*), communicating openings 41*f* and 41*g* are formed to cause the developing chamber 41*a* and the agitating chamber 41*b* to communicate with each other. The communicating openings 41*f* and 41*g* allow the developer to flow from the developing chamber 41*a* to the agitating chamber 41*b*, and vice versa.

In the present embodiment, the agitating-and-conveying screws 41*d* and 41*e* are both screw-like members. That is, each of the agitating-and-conveying screws 41*d* and 41*e* includes a magnetic rotation shaft and a spiral blade formed around the rotation shaft and serving as a conveyance portion. In the present embodiment, the agitating-and-conveying screw 41*e* disposed in the agitating chamber 41*b* further includes agitating ribs 12 in addition to the blade. The agitating ribs 12 protrude from the rotation shaft toward a radial direction of the shaft, and each has a predetermined width in the developer conveyance direction. The agitating ribs 12 agitate the developer with the rotation of the agitating-and-conveying screw 41*e*.

The agitating-and-conveying screw 41*d* conveys the developer of the developing chamber 41*a*, while agitating the developer. The agitating-and-conveying screw 41*e* conveys supplying developer supplied by a later-described developer supplying mechanism 49 and the developer having been contained in the agitating chamber 41*b* while agitating the supplied developer and the developer; and thereby equalizes toner density (i.e. ratio of a toner weight to a total weight of toner and carrier). The developer supplying mechanism 49, which serves as a supplying portion, performs auto toner replenisher (ATR) control. In the ATR control, the supplying developer is supplied to the developing apparatus 4, depending on an image ratio determined when an image is formed, a detection result determined by a later-described permeability sensor 45, and a detection result of a patch image density determined by an image density sensor 90 (FIGS. 1 and 2) used to detect the density of toner image.

The agitating-and-conveying screws 41*d* and 41*e* are disposed substantially parallel to each other in a direction (i.e. development width direction) in which the rotation axis of the developing sleeve 44 extends. The agitating-and-conveying screw 41*d* conveys the developer along the rotation axis of the developing sleeve 44 toward a direction opposite to a direction toward which the agitating-and-conveying screw 41*e* conveys the developer. Thus, the developer is circulated through the communicating openings 41*f* and 41*g*, in the developer container 41 by the agitating-and-conveying screws 41*d* and 41*e*. Specifically, the developer of the developing chamber 41*a* whose toner density is reduced due to toner consumption in the developing process is moved through the one communicating opening 41*f* (the left one in FIG. 3) to the agitating chamber 41*b* by the conveyance force of the agitating-and-conveying screws 41*d* and 41*e*, and the developer of the agitating chamber 41*b* whose toner is increased and agitated is moved through the other communicating opening 41*f* (the right one in FIG. 3) to the developing chamber 41*a*.

The developing chamber 41*a* of the developing apparatus 4 has a developing area (a facing area) which faces the photosensitive drum 1 and which is opened. The developing sleeve 44 is rotatably disposed in the opening of the developer container 41 such that one portion of the developing sleeve 44 is exposed. In the present embodiment, the developing sleeve 44 is made of a nonmagnetic material and is rotated in a direction indicated by an arrow of FIG. 4 when the developing operation is performed. Inside the developing sleeve 44, a magnet roll 44*a* is fixed to the developing sleeve 44. The magnet roll 44*a* serves as a magnetic-field generating portion and has a plurality of magnetic poles formed along the circumferential direction of the magnet roll 44*a*.

The developer of the developing chamber 41*a* (first chamber) is supplied to the developing sleeve 44 by the agitating-and-conveying screw 41*d*. The developer supplied to the developing sleeve 44 is carried by the developing sleeve 44, by a predetermined amount, due to a magnetic field generated by the magnet roll 44*a*, and thus an accumulated developer is formed on the developing sleeve 44. When the developing sleeve 44 rotates, the accumulated two-component developer formed on the developing sleeve 44 contacts the developing blade 42, then the thickness of the accumulated two-component developer is regulated by the developing blade 42, and then the accumulated two-component developer is conveyed to the developing area that faces the photosensitive drum 1. That is, the developing sleeve 44 carries the developer of the developing chamber 41*a* and conveys the developer to the developing area that faces the photosensitive drum 1.

The developer on the developing sleeve 44 is napped in the developing area to form magnetic brush. In the present embodiment, when the magnetic brush contacts the photosensitive drum 1, toner of the developer is supplied to the photosensitive drum 1, and thereby the electrostatic latent image on the photosensitive drum 1 is developed as a toner image. In addition, to increase the efficiency of developing, or the percentage of toner used for the electrostatic latent image, the developing sleeve 44 is commonly applied with a development bias voltage from a development bias power source (not illustrated) which serves as a voltage applying portion. The development bias voltage is a voltage in which a direct-current voltage is added with an alternate-current voltage. The developer left on the developing sleeve 44 after the toner has been supplied to the photosensitive drum 1 is returned to the developing chamber 41*a* by the rotation of the developing sleeve 44.

Here, the rotational speed (process speed) of the photosensitive drum 1 of the image forming apparatus 100 of the present embodiment is 300 mm/sec, and the rotational speed of the developing sleeve 44 is 450 mm/sec.

As described above, in the developing apparatus 4 which uses the two-component developer for the electrophotographic image forming apparatus 100, the toner and the carrier of the two-component developer of the developing apparatus 4 are agitated and charged by friction. Then the toner is supplied to the photosensitive drum 1 by the developing sleeve 44 to develop an electrostatic latent image on the photosensitive drum 1. In this time, although the toner is consumed and supplied, the carrier is neither consumed nor supplied, and left in the developing apparatus 4. Thus, since the carrier is agitated more in the developing apparatus 4 than the toner, the charging ability of the carrier easily deteriorates because of accumulation of additive, adhesion of wax, and toner spent. Then, the amount of conveyance of the developer is decreased and reduces friction (rubbing amount) of the developer and the amount of charge of the toner becomes short and causes defective images. For example, uneven density or fogged white will be produced in a formed image. The fogged white is a defect in which the toner sticks to an area of the photosensitive drum 1 in which no electrostatic latent image is formed.

In the present embodiment, to prevent the deterioration of the carrier, not only the toner but also the carrier is supplied as appropriate to the developing apparatus 4 by the developer supplying mechanism 49 illustrated in FIG. 3. The developer supplying mechanism 49 includes a supplying screw 4*h* to supply the developer from the toner container 8, a motor 49*a* to drive the supplying screw 4*h*, and a conveyance screw 49*b* to convey the developer, supplied via the supplying screw 4*h* toward the developing apparatus 4, to the agitating chamber 41*b*. The conveyance screw 49*b* is formed integrally with the agitating-and-conveying screw 41*e*, and has the same axis as that of the agitating-and-conveying screw 41*e*. The conveyance screw 49*b* conveys the developer, supplied to a supplying chamber 49*c*, to the agitating chamber 41*b* in a forward direction. The supplying chamber 49*c* has a supplying inlet which is connected to a conveyance path for the developer. The conveyance path extends from a position at which the supplying screw 4*h* is disposed.

In the present embodiment, the two-component developer containing the carrier is supplied by the developer supplying mechanism 49, and excess two-component developer which has been supplied and gradually increased in the developing apparatus 4 is discharged by a later-described auto carrier refresh (ACR) mechanism 43. With this configuration, the toner is supplied by the amount of toner which has been consumed and reduced, and the deteriorated carrier of the developing apparatus 4 is replaced with newly supplied carrier.

Since the two-component developer containing carrier is supplied and discharged in this configuration, the deterioration of carrier is prevented, and the developing property of the two-component developer of the developing apparatus 4 is kept constant. As a result, the deterioration of image quality due to change in the developing property of the developer can be prevented for a long time. In general, the developer discharged by the ACR mechanism 43 is stored by the toner collection box 57, together with the toner removed by the cleaning apparatus 7 and the intermediate transfer belt cleaner 55.

As illustrated in FIG. 3, the ACR mechanism 43, which serves as a discharging portion to discharge the developer of the developing apparatus 4, is disposed at an end portion of the agitating chamber 41*b* in the developer conveyance direction. Here, a configuration of the ACR mechanism 43 will be described with reference to FIG. 5. The agitating-and-conveying screw 41*e* of the agitating chamber 41*b* includes the spiral blade having fins and the agitating ribs 12 each formed like a plate. Each of the agitating ribs 12 is disposed perpendicular to the rotation shaft, between adjacent fins. In addition, at an end portion of the agitating-and-conveying screw 41*e* in the developer conveyance direction, a backing screw 41*h* is formed. The backing screw 41*h* has fins wound in an opposite direction so that the developer is conveyed in a direction opposite to the developer conveyance direction (forward direction). The fins of the backing screw 41*h* have a pitch smaller than that of the other fins of the agitating-and-conveying screw 41*e*, to increase conveyance force. Thus, the backing screw 41*h* receives the developer, which has been conveyed in the forward direction and delivers the developer to the developing chamber 41*a* through the communicating opening 41*g*.

When an image forming operation proceeds, and the supplying developer containing carrier is supplied, the amount of developer of the developer container 41 tends to gradually increase because only the toner is consumed in the image forming operation. Thus, the height of the surface of the developer of the developer container 41 increases with the increase in the amount of the developer. When the height of the surface of the developer exceeds a predetermined height, the conveyance capability of the backing screw 41*h* is exceeded. As a result, the developer climbs over the backing screw 41*h*.

Downstream from the backing screw 41*h*, there is disposed the auto carrier refresh mechanism 43 which includes a small discharging screw 43*b* having a conveyance capability to convey the developer in the forward direction and a developer outlet 43*a*. The developer having climbed over the backing screw 41*h* is conveyed to the developer outlet 43*a* by the discharging screw 43*b* and collected in the toner collection box 57 illustrated in FIG. 6. With this operation, the initial carrier is replaced with the carrier to be used for forming images. Here, in the present embodiment, the ratio of the toner to the carrier of the supplying developer is 9:1.

Configuration to Enclose Developer

Figure 7:
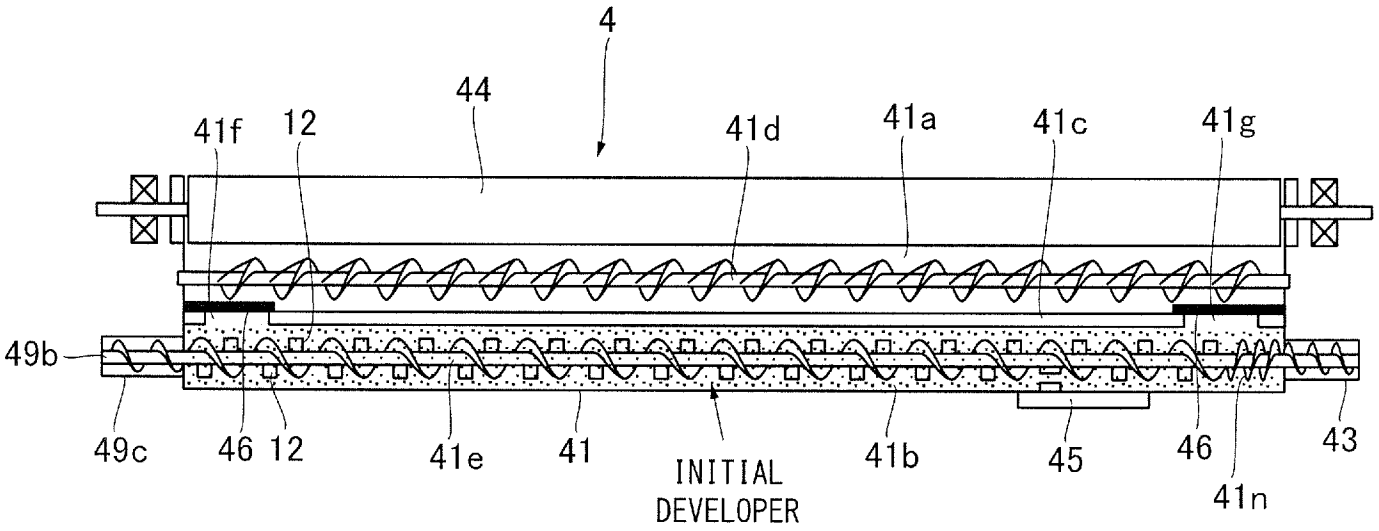
FIG. 7 is a schematic configuration diagram illustrating a state where a seal is applied to the communicating opening of the developing apparatus of the first embodiment.
Figure 8:
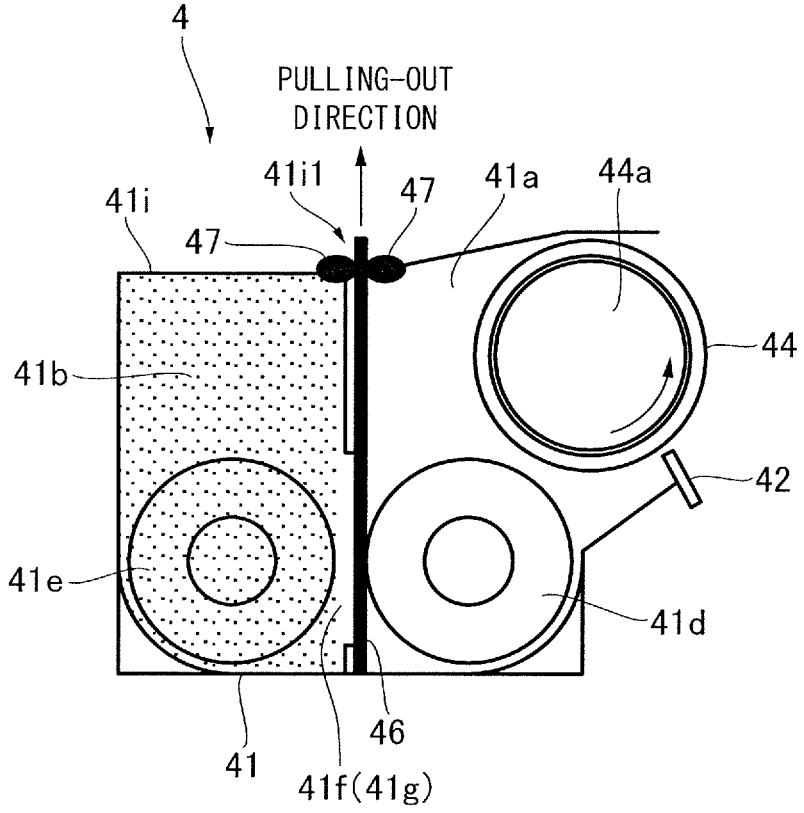
FIG. 8 is a schematic cross-sectional view illustrating the state where the seal is applied to the communicating opening of the developing apparatus of the first embodiment.

Here, a configuration of the present embodiment to enclose the developer of the developing apparatus 4 will be described with reference to FIGS. 7 and 8. The developing apparatus 4 of the present embodiment can be detachably attached to the apparatus body 100A (FIG. 1). Thus, a developing apparatus whose life has been reached can be removed from the apparatus body 100A, and another developing apparatus containing initial developer can be attached to the apparatus body 100A.

Thus, in the present embodiment, seals 46 which serve as sealing members are detachably attached to seal the communicating openings 41*f* and 41*g*, which are formed between the agitating chamber 41*b* and the developing chamber 41*a*. That is, the seals 46 seal the communicating openings 41*f* and 41*g* in a state where the agitating chamber 41*b* (second chamber) contains the developer (initial developer) and are removed from the communicating openings 41*f* and 41*g* when the developing apparatus 4 is used.

The seals 46 can be peeled off from slits 41*i*1 formed in a top cover 41*i* of the developing apparatus 4, so that the seals 46 can be removed even when the developing apparatus 4 is positioned with respect to a drum unit including the photosensitive drum 1. In addition, to prevent the developer from leaking from the slits 41*i*1, urethane members 47 having elasticity are disposed at both sides of each of the slits 41*i*1 to sandwich the seals 46. Here, the drum unit includes the charging roller 2, the cleaning apparatus 7, and the photosensitive drum 1, for example.

The seals 46 to seal the communicating openings 41*f* and 41*g*, which allow the developing chamber 41*a* and the agitating chamber 41*b* to communicate with each other, may be Mylar sheets. The Mylar sheets cover and heat-seal the communicating openings 41*f* and 41*g*. As illustrated in FIG. 8, the seals 46, which may be Mylar sheets, protrude upward from the slits 41*i*1 of the top cover 41*i*, sandwiched by the urethane members 47. Thus, when the seals 46 are pulled upward and removed, the sealing is released.

In addition, since the communicating openings 41*f* and 41*g* are sealed by the seals 46 in the state where the agitating chamber 41*b* contains the initial developer, the developer is prevented from leaking from a portion between the developing sleeve 44 and the developer container 41, or a portion between the developing sleeve 44 and the developing blade 42. Thus, in this state, soiling caused by the leakage of the developer can be prevented during delivery of the developing apparatus 4. The configuration to enclose the initial developer has an advantage in which the seals 46 can be removed from a top portion or a side portion of the developer container 41 in a state where the developing apparatus 4 is in contact with the drum unit including the photosensitive drum 1.

In the image forming apparatus 100, a frame unit in which the developing apparatus 4 and the drum unit are set can be drawn from the front side of the apparatus body 100A for maintenance of the developing apparatus 4 and the drum unit. Normally, the developing apparatus 4 and the drum unit are pressed toward each other to keep a constant developing nip distance between the developing sleeve 44 and the photosensitive drum 1. Thus, the configuration that allows the seals 46 to be pulled upward and removed facilitates maintenance, because the above-described configuration, in which the developing apparatus 4 and the drum unit are pressed toward each other, needs not to be changed when the seals 46 are removed.

Control Portion

Next, a control portion 200 of the image forming apparatus 100 will be described with reference to FIG. 9. The control portion 200 includes a central processing unit (CPU) 201 which serves as a control unit or a setting portion, and a memory 202. The memory 202 includes a read only memory (ROM) 202*a*. The ROM 202*a* stores programs associated with control procedures. The CPU 201 controls each unit while reading the programs stored in the ROM 202*a*. The memory 202 also includes a random access memory (RAM) 202*b* which stores work data and input data. The CPU 201 performs control, depending on the above-described programs and referring to the data stored in the RAM 202*b*.

The CPU 201 is connected to an input/output (I/O) device 203 and an engine control portion 204. The input/output device 203 sends/receives signals to/from a host device or the like. The engine control portion 204 receives instructions from the CPU 201, and controls an image forming engine portion 205 of each image forming portion. The image forming engine portion 205 is used to form images, and includes the charging roller 2, the exposure apparatus 3, the developing apparatus 4, the developer supplying mechanism 49, the intermediate transfer apparatus 5, and the fixing apparatus 6. In addition, the engine control portion 204 is connected to a new-article detecting device 206 to detect whether the developing apparatus 4 is a new article or not. Thus, the engine control portion 204 detects whether the developing apparatus 4 is a new article or not, depending on a detection result by the new-article detecting device 206.

As illustrated in FIG. 3, the developer supplying mechanism 49 includes the supplying screw 4*h*, which is driven by the motor 49*a*. The rotation of the motor 49*a* is controlled by the engine control portion 204. In addition, under a condition in which a predetermined amount of toner is stored in the toner container 8, a relationship between the rotation time of the motor 49*a* and the mount of toner supplied to the developer container 41 by the supplying screw 4*h* has been determined in advance through an experiment. The relationship is stored, as table data, in the ROM 202*a* connected to the CPU 201, or included in the CPU 201. That is, the CPU 201 adjusts the amount of toner to be supplied to the developer container 41, by controlling (adjusting) the rotation time of the motor 49*a*.

Permeability Sensor

As illustrated in FIG. 3, the developer container 41 is provided with the permeability sensor (inductance sensor) 45 which serves as a toner-density detecting portion to detect the toner density of the developing apparatus 4. The permeability sensor 45 is disposed downstream in the agitating chamber 41*b*, in the direction in which the developer is conveyed by the agitating-and-conveying screw 41*e*.

Figure 9:
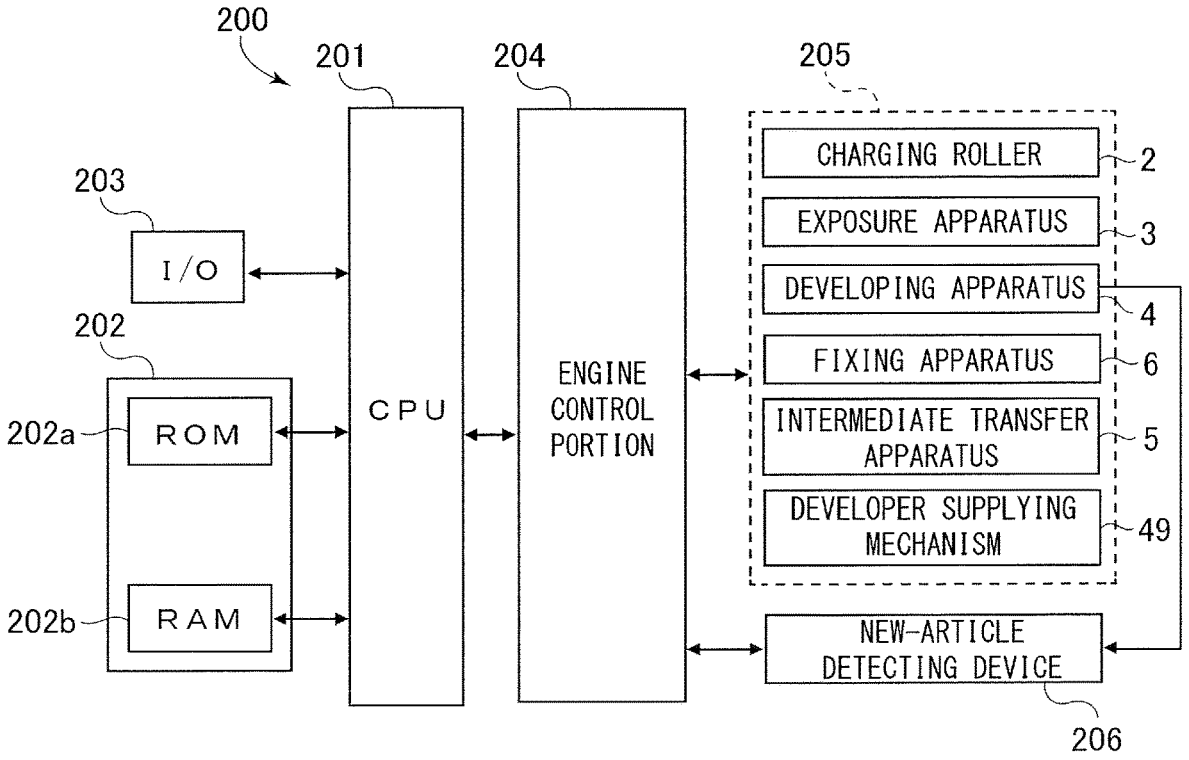
FIG. 9 is a control block diagram of the image forming apparatus of the first embodiment.
Figure 10:
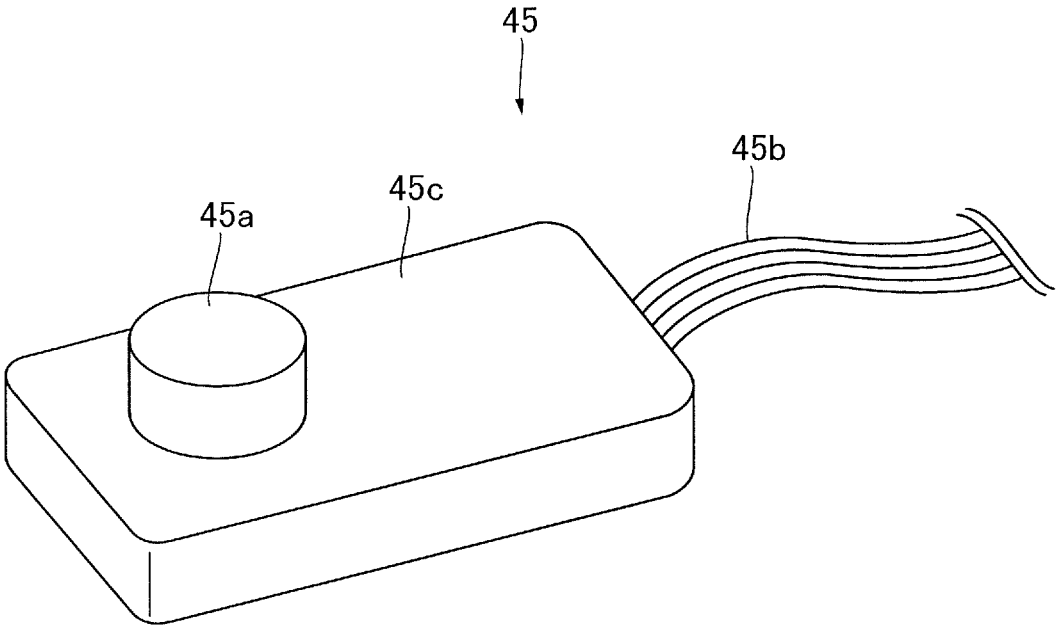
FIG. 10 is a perspective view of a permeability sensor of the first embodiment.

As illustrated in FIG. 10, in the permeability sensor 45, a cylindrical detecting head 45*a* is disposed on a sensor body 45*c*, and is formed integrally with the same. The permeability sensor 45 sends/receives signals to/from the CPU 201 (FIG. 9) of the image forming apparatus 100, via a signal line 45*b* used for input and output.

The detecting head 45*a* includes a detecting transformer. The detecting transformer includes three windings: a primary winding, a reference winding, and a detecting winding. The reference winding and the detecting winding constitute a secondary winding. The detecting winding is disposed on the top surface side of the detecting head 45*a*, the reference winding is disposed on the bottom surface side of the detecting head 45*a*, and the primary winding is disposed between the detecting winding and the reference winding. When a current signal having a predetermined waveform flows in the primary winding from an oscillator disposed in the sensor body 45*c*, another current signal having a waveform flows in the secondary winding, constituted by the reference winding and the detecting winding, due to electromagnetic induction. The permeability sensor 45 causes a comparator of the sensor body 45*c* to compare the current signal generated by the oscillator and having the predetermined waveform, with the current signal induced in the detecting winding due to the electromagnetic induction and having the waveform; and thereby detects the density of the magnetic material that exists near the top surface of the detecting head 45*a*.

Figure 11:
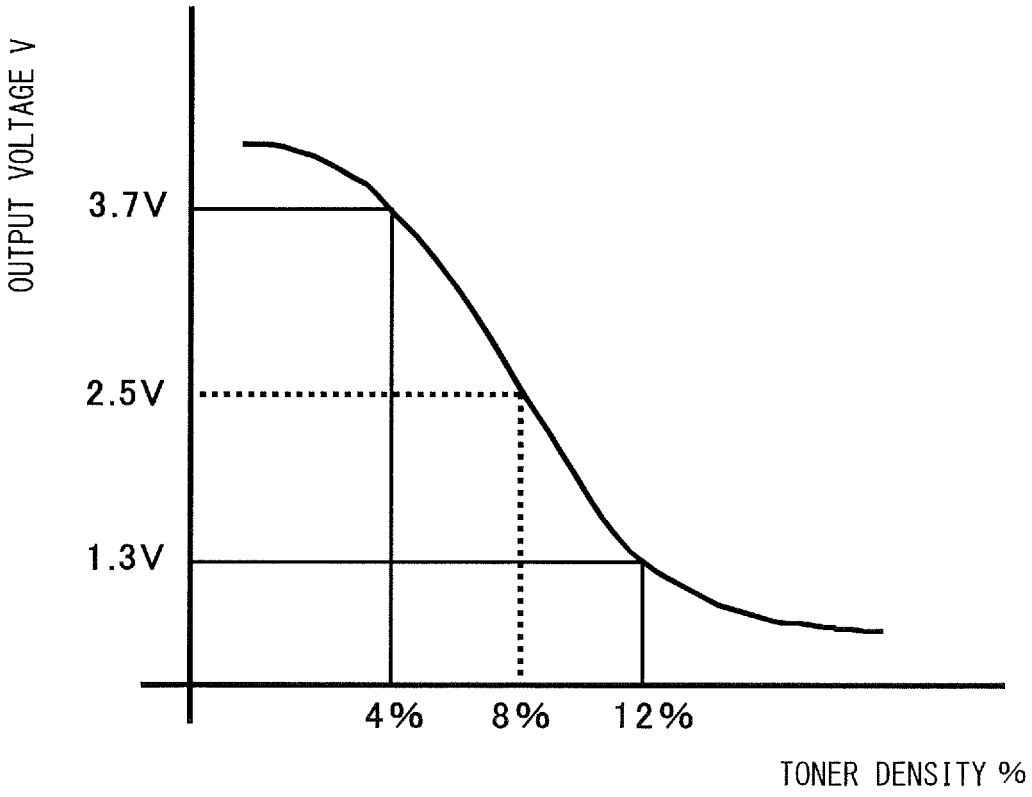
FIG. 11 is a graph illustrating a relationship between toner density and the output voltage of the permeability sensor.

Here, a relationship between the toner density of the developer and the output from the permeability sensor 45 will be described. FIG. 11 illustrates one example of the output characteristic of the permeability sensor 45. In FIG. 11, the output voltage (sensor output) is saturated at a large value in a range where the toner density is small, gradually decreased as the toner density is increased, and saturated at a small value in a range where the toner density is large. In the present embodiment, the permeability sensor 45 is adjusted so as to output a voltage of about 2.5 V when the toner density has a normal value of 8% (weight percentage, which holds true also in the following description). In a range of voltages near 2.5 V, the output voltage changes almost linearly with respect to the toner density.

As described above, the toner density of the developer of the developing apparatus 4 is detected by the permeability sensor 45. Depending on the detection result by the permeability sensor 45, the supplying screw 4*h* (FIG. 3) of the developer supplying mechanism 49 is driven, the supplying developer is supplied to the developing apparatus 4, and thereby the toner density of the developing apparatus 4 is kept constant. That is, depending on the detection result by the permeability sensor 45, the CPU 201 determines the rotation time of the motor 49*a*, and rotates the motor 49*a* for the rotation time. The ROM 202*a* (or the CPU) stores information used to determine the amount of developer to be supplied to the developing apparatus 4. The information is determined, depending on the relationship between the sensor output from the permeability sensor 45 illustrated in FIG. 11 and the toner density; and is stored as table data. Thus, the CPU 201 can use the information and table data indicating a relationship between the above-described rotation time of the motor 49*a* and the amount of toner to be supplied, determine the number of rotations of the supplying screw 4*h*, and thereby control the amount of developer to be supplied.

Typically, the developer supplying control, which uses the permeability sensor 45 and the inductance detecting method, determines the number of rotations of the supplying screw 4*h* and supplies toner every time an image forming operation is performed on a single recording material. Here, a target toner density of the present embodiment is 8% for all developers of yellow, magenta, cyan, and black.

Toner Collection Box

As illustrated in FIG. 6, the toner collection box 57 collects the developer discharged from the cleaning apparatus 7, the intermediate transfer belt cleaner 55, and the auto carrier refresh mechanism 43 of the developing apparatus 4.

The toner collection box 57 includes a near end sensor 57*a* which detects that the toner collection box 57 is nearly full of the toner. As the toner is accumulated in the toner collection box 57, the surface of the powder rises and reaches the near end sensor 57*a*. At this time, the CPU 201 determines that the toner collection box 57 is nearly full of the toner.

When the near end sensor 57*a* detects that the toner collection box 57 is nearly full of the toner, the CPU 201 causes a control panel (not illustrated) of the image forming apparatus 100 to display a message instructing a user to prepare a new toner collection box. This message can inform the user that the toner collection box 57 is nearly full of the toner. After the detection by the near end sensor 57*a*, the CPU 201 calculates an accumulated supplied-developer amount in which supplied developers of yellow, magenta, cyan, and black are totalized, and stores the accumulated supplied-developer amount. When the accumulated supplied-developer amount reaches a predetermined threshold, the CPU 201 determines that the toner collection box is full of the toner and causes the control panel to display a message instructing a user to replace the toner collection box with a new toner collection box. During this operation, the image forming operation is disabled.

Operation Process of Image Forming Apparatus

Figure 12:
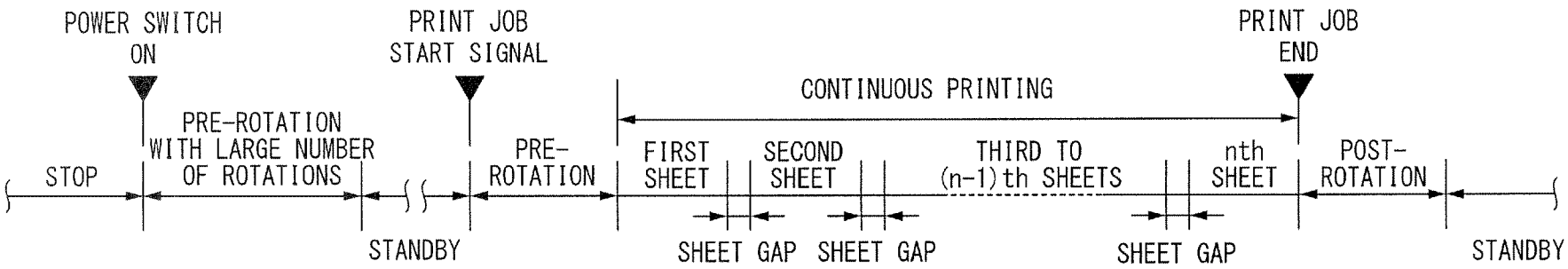
FIG. 12 is a diagram illustrating an operation process of the image forming apparatus of the first embodiment.

Next, an operation process of the image forming apparatus 100 will be described with reference to FIG. 12.

Initial Rotation (Pre-Rotation Process with Large Number of Rotations)

This process is performed in starting-operation time (warm-up time) for the image forming apparatus 100. When a power switch is turned on, preparatory operations of predetermined processing components are performed. For example, a main motor of the image forming apparatus 100 is started, the photosensitive drum 1 is rotated, and the fixing apparatus 6 is heated to a predetermined temperature.

Standby Mode

After the starting-operation time, the main motor is stopped, and the image forming apparatus 100 is kept in a standby mode until a print job (image forming job) start signal is received.

Preparatory Rotation for Printing (Pre-Rotation Process)

This process is performed, before an image is formed, in a preparatory rotation time from when the print job start signal is received until when an actual image forming (or print) operation is started. More specifically, in this process, the print job start signal is received by the image forming apparatus 100, then an image is developed by a formatter (the developing time depends on the amount of data of the image and the processing speed of the formatter), and then the pre-rotation process is started.

If the print job start signal is received during the initial rotation, the standby mode is not performed, and the pre-rotation process is performed after the initial rotation. When the print job start signal is not received, the main motor is stopped after the initial rotation, the rotation of the photosensitive drum 1 is stopped, and the printer is kept in the standby mode until the print job start signal is received. When the print job start signal is received, the pre-rotation process is performed.

Printing Process (Image Forming Process)

After the pre-rotation process, an image forming process is performed on the rotating photosensitive drum 1. Then, a toner image formed on the surface of the rotating photosensitive drum 1 is transferred onto a recording material via the intermediate transfer belt 51, then the transferred toner image is fixed to the recording material by the fixing apparatus 6, and then the formed image is printed out. When a continuous printing job is performed, the above-described printing process is repeated a predetermined number n of times equal to the number of sheets on which an image is to be formed.

Pater-Sheet Gap Process

This process is performed, in a continuous printing job, in a period of time from when the trailing edge of a recording material passes a transfer position (of the secondary transfer portion T2) until when the leading edge of the following recording material reaches the transfer position. Thus, in the period of time, any recording material does not pass the transfer position. That is, the period of time corresponds to a gap between successive recording materials. Here, although the recording material may not be a paper sheet, the period of time in which the recording material does not pass the transfer position is referred to as a paper sheet gap for convenience.

Post-Rotation Process

The main motor is continuously driven for a predetermined period of time after an image-formed recording material is outputted in a printing job for a single sheet, or after an image-formed last recording material is outputted in a continuous printing job. Thus, in this period of time, post-operations of the predetermined processing components are performed after the printing job. Specifically, in this period of time, the photosensitive drum 1 is rotated by the continuously-driven main motor to perform the predetermined post-operation, for the predetermined time even after the printing process for the last recording material is completed.

Standby Mode

After the post-rotation process, the main motor is stopped to stop the rotation of the photosensitive drum 1. The image forming apparatus 100 is then kept in a standby mode until the next print job start signal is received. When printing is performed on a single sheet, the printer enters the standby mode after the printing and the post-rotation process are completed. When receiving the print job start signal in the standby mode, the printer performs the pre-rotation process.

Here, an image is formed in the above-described printing process, and no image is formed in the above-described pre-rotation process with the large number of rotations, pre-rotation process, paper-sheet gap process, and post-rotation process. The period of time in which no image is formed corresponds to at least one of the above-described pre-rotation processes with the large number of rotations, pre-rotation process, paper-sheet gap process, and post-rotation process, or a predetermined time of the at least one of the above-described processes.

Developer Supplying Control Including Patch Detecting Method

Next, developer supplying control using a patch detecting method will be described. As illustrated in FIGS. 1 and 2, the image forming apparatus 100 includes the image density sensor 90, which serves as a density detecting portion and detects the density of a control toner image (patch image). The image density sensor 90 is disposed downstream from the image forming portion PK (which is one of the image forming portions and located most downstream); and faces an outer circumferential surface of the intermediate transfer belt 51, located upstream from the secondary transfer portion T2. The image density sensor 90 detects the density of the patch image, which has been transferred onto the intermediate transfer belt 51. In the present embodiment, forming the patch image and detecting the density of the patch image by using the image density sensor 90 are called patch detection, and the developer supplying control is performed by using the patch detection (patch detecting method) and the above-described inductance detecting method. Hereinafter, the detailed description thereof will be made.

In the patch detection, a predetermined reference latent image (patch latent image) is formed on the photosensitive drum 1 when no image is formed, and then a reference toner image (control toner image, or patch image) is formed on the photosensitive drum 1 by developing the predetermined reference latent image under a predetermined developing condition. The patch image is then transferred onto the intermediate transfer belt 51, and the density of the patch image is detected by the image density sensor 90. The image density sensor 90 sends a density signal indicating the patch image density (the amount of sticking toner), to the CPU 201 (FIG. 9). The CPU 201 compares the density signal from the image density sensor 90, with an initial reference signal pre-stored in the CPU 201; and performs later-described control, in accordance with a comparison result.

The image density sensor 90 may use an ordinary reflective optical sensor. The CPU 201 reads a predetermined environment table (which stores set values for process conditions based on temperature and humidity information and set values for process conditions such as exposure intensity, developing bias, and transfer bias) stored in the ROM 202*a* when the image forming apparatus 100 was installed. The charged photosensitive drum 1 is exposed to the laser beam in accordance with this table, to form the patch latent image, and a patch image is formed by developing the patch latent image.

Furthermore, the CPU 201 corrects a target value (i.e. target inductance signal value corresponding to a target toner density) of the inductance detection signal detected by the permeability sensor 45, by using a signal value of the patch image density detected by the image density sensor 90. The amount of charge of the toner of the developer of the developing apparatus 4 significantly varies depending on long-term use, continuous use, change in use condition, deteriorated carrier, and the like. In this case, even though the toner density is kept constant, it may be difficult to keep stable image density and color.

Thus, in the present embodiment, the CPU 201 corrects the target value of the inductance detection signal, as appropriate, by using the patch image density (detection result) detected by the image density sensor 90. By correcting the target value of the inductance detection signal, the amount of developer to be supplied from the developer supplying mechanism 49 is controlled. For this purpose, the CPU 201 controls the amount of developer to be supplied from the developer supplying mechanism 49, depending on a detection result by the image density sensor 90. With this operation, since the change in the amount of charge of the toner can be suppressed, significant change in image density can be suppressed.

Figure 13:
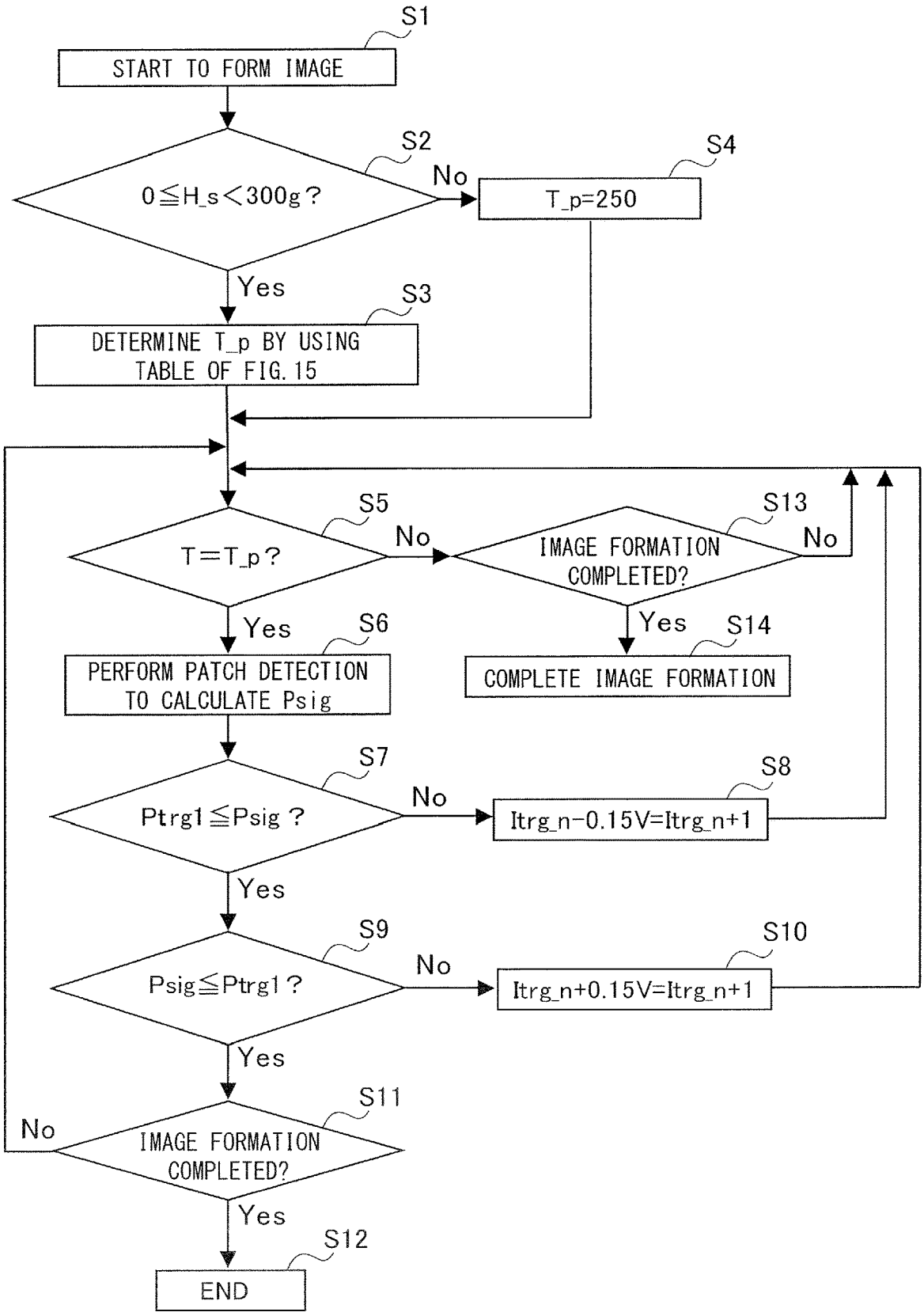
FIG. 13 is a flowchart illustrating induction-detection toner supply control of the first embodiment.

Next, the developer supplying control of the present embodiment using the patch detecting method will be described with reference to FIG. 13. FIG. 13 is a flowchart illustrating processes from the start to the end of an image forming operation. In FIG. 13, a symbol T denotes the number of image-outputted sheets (the number of image-formed sheets) counted from when a patch image was formed in the last time by using the developing apparatus 4, a symbol T_p denotes the number of sheets (frequency) which causes the patch image to be formed, and a symbol Ptrg1 denotes a target toner-image-density value (a target signal value) of the patch image. The target toner-image-density value Ptrg1 of the present embodiment is 500. In addition, a symbol Psig is an image-density signal value of the patch image, a symbol Itrg(n) is a pre-correction target inductance signal value, and a symbol Itrg(n+1) is a post-correction target inductance signal value. In the present embodiment, the number of image-outputted sheets produced by using the developing apparatus 4 is calculated by the CPU 201 and stored in the memory 202 included in or connected to the CPU 201.

After starting to form an image (S1), the CPU 201 determines T_p in steps S2 to S4. The steps S2 to S4 will be described later. The CPU 201 then determines whether the number T of image-outputted sheets counted from when a patch image was formed in the last time reaches T_p (S5). If the number T of image-outputted sheets reaches T_p in S5 (S5: Yes), then the CPU 201 forms a patch image, causes the image density sensor 90 to detect the density of the patch image, and calculates an image density Psig (S6).

The CPU 201 then determines whether the relationship between the detected image density Psig of the patch image and the target toner-image-density value Ptrg1 satisfies Ptrg1≤Psig (S7). If the relationship does not satisfy the above-described expression, that is, if Ptrg1>Psig (S7: No), then the CPU 201 changes the target inductance signal value (target toner density) (S8). Specifically, the CPU 201 subtracts 0.15 V (which corresponds to a toner density of 0.5%) from Itrg(n), and sets the resulting value (Itrg(n)−0.15) to the post-corrected target inductance signal value Itrg(n+1) (S8).

When the image density Psig of the patch image is lower than the target toner-image-density value Ptrg1, the amount of charge of the toner of the developing apparatus 4 is large. Thus, to decrease the amount of charge of the toner of the developing apparatus 4, the CPU 201 increases the density of the toner of the developing apparatus 4, by using the relationship illustrated in FIG. 11 and decreasing the target inductance signal value. When the toner density is increased, the toner contacts the carrier less frequently, which decreases the amount of charge of the toner.

In contrast, if the relationship satisfies Ptrg1≤Psig (S7: Yes), then the CPU 201 determines whether the relationship between the patch image density Psig and the target toner-image-density value Ptrg1 satisfies Psig≤Ptrg1 (S9). If the relationship does not satisfy the above-described expression, that is, if Psig>Ptrg1 (S9: No), then the CPU 201 changes the target inductance signal value (target toner density) (S10). Specifically, the CPU 201 adds 0.15 V (which corresponds to a toner density of 0.5%) to the target inductance signal value Itrg(n) and sets the resulting value (Itrg(n)+0.15) to the post-corrected target inductance signal value Itrg(n+1) (S10).

When the image density Psig of a patch image is higher than the target toner-image-density value Ptrg1, the amount of charge of the toner of the developing apparatus 4 is small. Thus, to increase the amount of charge of the toner of the developing apparatus 4, the CPU 201 decreases the density of the toner of the developing apparatus 4, by using the relationship illustrated in FIG. 11 and increasing the target inductance signal value. When the toner density is decreased, the toner contacts the carrier more frequently, which increases the amount of charge of the toner.

If the relationship satisfies Psig≤Ptrg1 in S9 (S9: Yes), then the CPU 201 determines whether the image forming operation is completed (S11). The CPU 201 ends the image forming process (S12) if the image forming operation is completed (S11: Yes), or returns to S5 if not (S11: No). Here, when the relationship satisfies Ptrg1≤Psig in S7, and Psig≤Ptrg1 in S9, Psig is equal to Ptrg1. In this case, the target inductance signal value (target toner density) needs not to be changed. Thus, the CPU 201 does not change the target inductance signal value (target toner density), and continues to form images.

If the number T of image-outputted sheets counted from when a patch image was formed in the last time by using the developing apparatus 4 does not reach T_p in S5 (S5: No), then the CPU 201 determines whether the image forming operation is completed (S13). The CPU 201 ends the image forming process (S14) if the image forming operation is completed (S13: Yes), or returns to S5 if not (S13: No).

In the present embodiment, upper and lower limits of the above-described target inductance signal value Itrg are provided. The upper and lower limits are 2.5±0.6 V (which correspond to toner densities of 8±2%). The upper and lower limits are provided because toner fog and toner fly may occur when the toner density is extremely high, and carrier sticking and rough image may occur when the toner density is extremely low. Thus, when Ptrg1<Psig, Itrg(n+1) does not become larger than 3.1 V; when Ptrg1>Psig, Itrg(n+1) does not become smaller than 1.9 V. In this case, Itrg(n+1) is 3.1 V or 1.9 V (that is, fixed to 3.1 V or 1.9 V).

Thus, in the flowchart of FIG. 13, the toner supply control using the inductance detecting method is corrected by using the patch detecting method. As previously described, the inductance detecting method typically determines the number of rotations of the supplying screw 4*h* and supplies toner every time an image forming operation is performed on the single recording material S.

Initializing Operation of Developing Apparatus

Next, an initializing operation of the developing apparatus 4 performed when the power for the image forming apparatus 100 is turned on will be described. The developing apparatus 4 includes a fuse which is the new-article detecting device 206 (FIG. 9), and a board terminal of the fuse is in contact with a contact of the apparatus body of the image forming apparatus 100. When the power for the image forming apparatus 100 is turned on, predetermined current flows through the fuse and blows it if the developing apparatus 4 is a new article. In this manner, the engine control portion 204 determines that the developing apparatus 4 is a new article. If the developing apparatus 4 is not a new article, the current does not flow through the fuse because the fuse has already been blown. In this case, the engine control portion 204 determines that the developing apparatus 4 is a used article.

Figure 14:
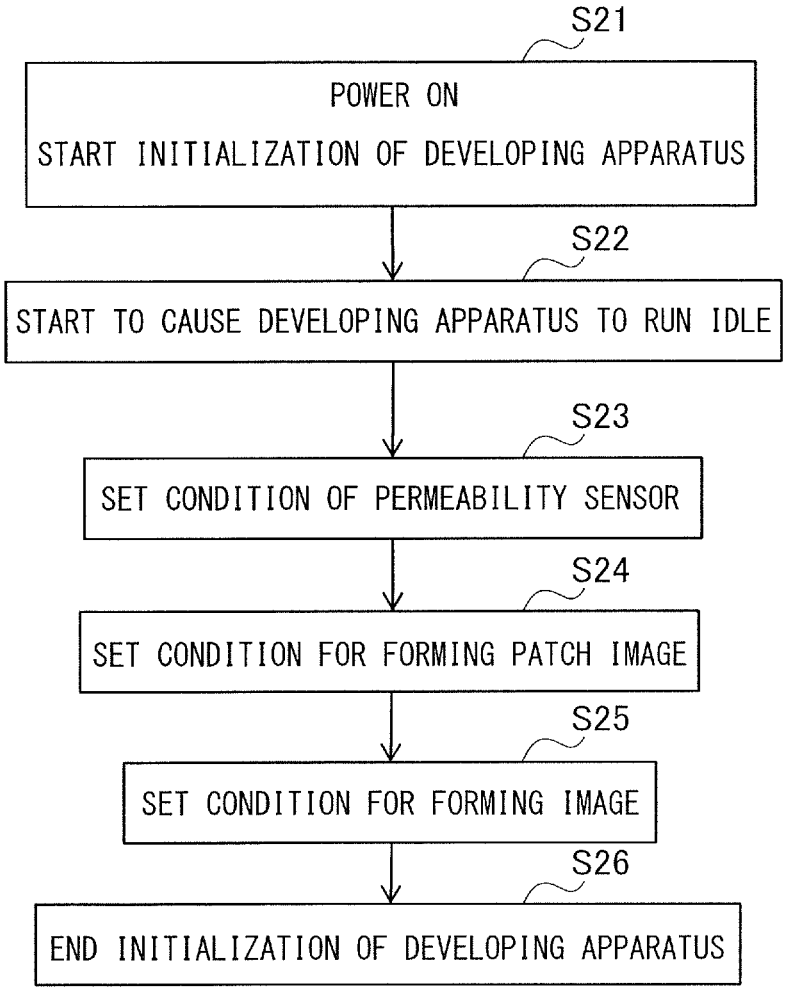
FIG. 14 is a flowchart illustrating an initializing operation of the developing apparatus of the first embodiment.

As illustrated in FIG. 14, when the developing apparatus 4 is installed and determined as a new article, the image forming apparatus 100 performs an initializing operation after the power is turned on. In the initializing operation, when the power for the image forming apparatus 100 is turned on (S21), the CPU 201 causes the developing apparatus 4 to run idle for a predetermined period of time, so that the developer of the developing apparatus 4 is uniformly distributed in the developer container, and that the amount of charge of the developer is increased (S22). In the present embodiment, the CPU 201 causes the developing apparatus 4 to run idle for 60 seconds.

In the idling operation, the developing apparatus 4 is activated in a state where the other units, such as the photosensitive drum 1, the intermediate transfer belt 51, and the fixing apparatus 6, are deactivated, and where high voltages used for various purposes are turned off; and the agitating-and-conveying screws 41*d* and 41*e* are rotated. However, even when the other units, such as the photosensitive drum 1, and the high voltages used for various purposes are activated, the developing apparatus 4 may be activated in a state where no image is formed (no electrostatic latent image is formed, that is, a so-called solid white image is formed). In a case where the developing sleeve 44 and the agitating-and-conveying screws 41*d* and 41*e* can be separately driven, at least the agitating-and-conveying screws 41*d* and 41*e* may be rotated in the idling operation.

After the idling operation of the developing apparatus 4, the CPU 201 sets conditions for the permeability sensor 45 (S23). In the present embodiment, after the idling operation for 60 seconds, the CPU 201 causes the developing apparatus 4 to run idle for 1 second without stopping the developing apparatus 4. In this period of time, the CPU 201 receives output values from the permeability sensor 45, 20 times, at intervals of 50 milliseconds. The CPU 201 then calculates an average detection value of the twenty output values and stores the average detection value in the CPU 201, as a target value of the permeability sensor 45.

Then, the CPU 201 sets a patch image forming condition (S24). Then, a patch image (toner test pattern) formed under predetermined image-forming conditions (charging voltage for the photosensitive drum 1, development bias voltage, transfer voltage, exposure amount) is formed on the photosensitive drum 1. The patch image is then transferred onto the intermediate transfer belt 51, then the density of the patch image is detected by the image density sensor 90, and then the toner-image-density signal value detected by the image density sensor 90 is stored in the CPU 201, as a target value.

Then, the CPU 201 sets image forming conditions (S25). Patch images (toner test patterns) formed under predetermined image-forming conditions (charging voltage for the photosensitive drum 1, development bias voltage, transfer voltage, gradation correction table, etc.) are formed on the photosensitive drum 1. The patch images are formed with a plurality of different exposure amounts (low density and medium density). Then, the patch images are transferred onto the intermediate transfer belt 51, and the CPU 201 causes the image density sensor 90 to estimate output values (optimum charging voltage, optimum development bias voltage, optimum transfer voltage, and optimum gradation correction table). The CPU 201 then causes the image forming apparatus 100 to enter the standby mode again and completes the initializing operation (S26).

Operation of Developing Apparatus in Initial State

Here, an operation of the developing apparatus 4 in the initial state will be described. In the initial state, a new developing apparatus 4 is installed in the image forming apparatus 100, the above-described initializing operation is completed, and the image forming operation is started. The new developing apparatus 4 contains the developer by predetermined amount (120 g in the present embodiment). The developing apparatus 4 of the present embodiment causes the auto carrier refresh mechanism 43 to discharge the developer when the amount of developer of the developing apparatus 4 is 150 g or more. That is, in the present embodiment, the amount (120 g) of the developer contained in the agitating chamber 41*b* in a state where the communicating openings 41*f* and 41*g* are sealed by the seals 46 is smaller than the amount (150 g) of the developer obtained when the auto carrier refresh mechanism 43 starts to discharge the developer in use of the developing apparatus 4.

Thus, when the initializing operation of the developing apparatus 4 is completed, the amount of developer of the developing apparatus 4 is 120 g. After that, as the image forming operation proceeds, toner and carrier will be supplied to the developing apparatus 4 by the developer supplying mechanism 49. In addition, when the amount of developer of the developing apparatus 4 reaches 150 g, the auto carrier refresh mechanism 43 starts to discharge the developer.

The reason that the amount of developer of the developing apparatus 4 of the present embodiment is reduced to 120 g will be described in detail. When the sealing by the seals 46 of the new developing apparatus 4 is released, some of the developer having stayed in the communicating openings 41*f* and 41*g* flows from the agitating chamber 41*b*, which contains the initial developer, to the developing chamber 41*a*. However, most of the developer stays in the agitating chamber 41*b*.

When the developing apparatus 4 is attached to the apparatus body 100A of the image forming apparatus 100, and the power is turned on, the developing apparatus 4 is detected as a new article, and the above-described initializing operation is performed. When the developing apparatus 4 runs idle in the initializing operation, the developer of the agitating chamber 41*b* flows downstream in the agitating chamber 41*b*, and gradually flows to the developing chamber 41*a* and the surface of the developing sleeve 44. Eventually, the developer spreads uniformly in the developer container 41.

Figure 5:
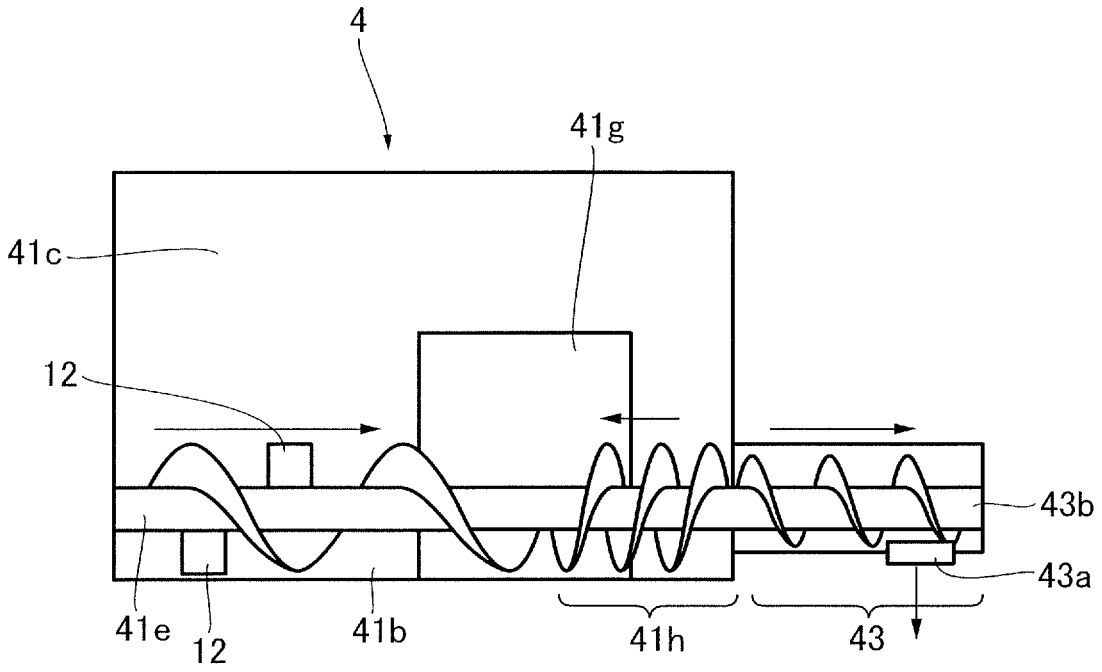
FIG. 5 is a schematic configuration diagram of a communicating opening of the developing apparatus and its surroundings.

If the amount of developer of the developing apparatus 4 is large (120 g or more in the present embodiment), some developer may climb over the backing screw 41*h* with the aid of the auto carrier refresh mechanism 43 and may be discharged from the developer outlet 43*a* (FIG. 5). Thus, if the developer of the developing apparatus 4 is discharged, the toner collection box 57 will be replaced sooner. In addition, since the discharged developer is not used for forming images, it will be uselessly disposed of. For these reasons, in the present embodiment, the amount of developer of the developing apparatus 4 is 120 g.

Thus, for preventing a large amount of developer from being discharged in the initializing operation, the amount of initial developer of the developing apparatus 4 is reduced. In this manner, the developer is prevented from being discharged in the idling operation.

On the other hand, if the amount of initial developer is reduced, there are the following problems. For example, when an image having a high duty (i.e. high image ratio) is successively formed on sheets, supplied toner will not be sufficiently charged because the amount of carrier of the developing apparatus 4 is small. As a result, increased image density, toner fly, and toner fog may occur. In contrast, when an image having a low duty (i.e. low image ratio) is successively formed on sheets, the toner of the developing apparatus 4 will not be consumed and will be left in the developing apparatus 4. As a result, the toner deteriorates while circulating in the developing apparatus 4, possibly causing decreased image density and rough image.

However, when carrier is supplied together with toner in the image forming process, then the amount of developer of the developing apparatus 4 gradually increases, and then the amount of developer reaches a value (i.e. predetermined amount of developer, which is 150 g in the present embodiment) obtained when the auto carrier refresh mechanism 43 starts to discharge the developer, the above problems will be solved.

Thus, in the present embodiment, after the initializing operation of the developing apparatus 4, the frequency of forming the patch image is changed in accordance with the amount of carrier supplied to the developing apparatus 4, that is, the amount of developer of the developing apparatus 4. Specifically, the frequency of forming the patch image is increased when the amount of developer is small and decreased when the amount of developer is increased due to a long-time image forming operation.

Frequency of Forming Patch Image

Here, a method of the present embodiment to determine the frequency of forming the patch image will be described with reference to S2 to S4 of FIG. 13, and FIG. 15. The frequency of forming the patch image corresponds to the number of image-formed sheets between the patch images in a successive image forming process, which causes the patch image to be formed. As described above, in the present embodiment, the ratio of the toner to the carrier of the supplying developer is 9:1. Thus, after the initializing operation of the developing apparatus 4 is completed and the image forming operation is started, the amount of developer of the developing apparatus 4 reaches 150 g (predetermined amount of developer) when the supplying developer has been supplied by about 300 g.

The present embodiment uses an accumulated supplied-developer amount H_s calculated from the initializing operation of the developing apparatus 4, as information on the amount of developer of the developing apparatus 4 and changes the frequency of forming the patch image. In the present embodiment, the frequency of forming the patch image corresponds to the number of image-formed sheets which causes the patch image to be formed. That is, the information on the amount of developer of the developing apparatus 4 indicates the amount of developer (accumulated supplied-developer amount H_s) supplied by the developer supplying mechanism 49 from when the seals 46 are removed and the use of the developing apparatus 4 is started. Specifically, as illustrated in FIG. 13, after starting to form an image (S1), the CPU 201 determines whether $0 \leq H_s < 300$ g is satisfied (S2). If $0 \leq H_s < 300$ g is satisfied (S2: Yes), then the CPU 201 determines the number T_p of image-formed sheets which causes the patch image to be formed (that is, patch image forming interval), depending on a table of FIG. 15 (S3). That is, the CPU 201 changes the frequency of forming the patch image (patch image forming interval T_p), in accordance with the accumulated supplied-developer amount H_s, in a period of time from when the seals 46 are removed and the use of the developing apparatus 4 is started, until when the amount of developer of the developer container 41 reaches the predetermined amount of developer (150 g).

Figure 15:
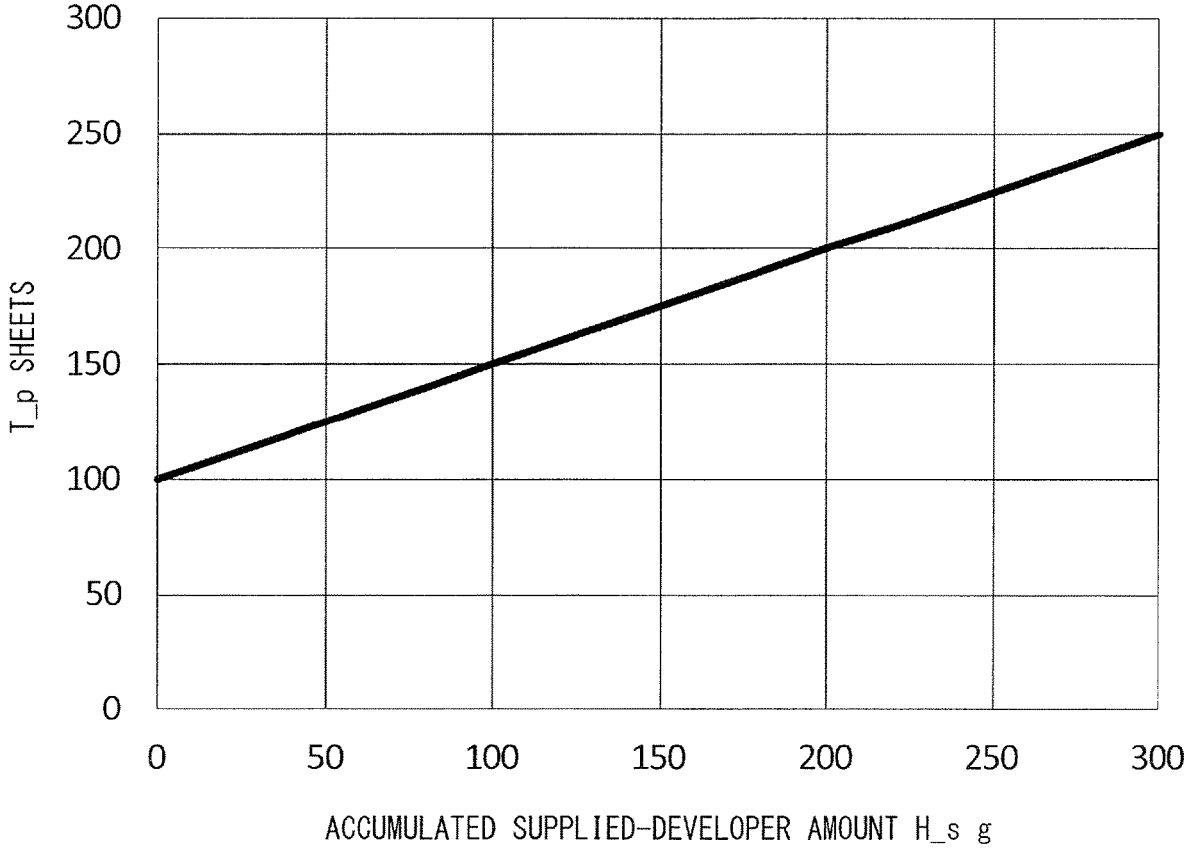
FIG. 15 is a graph illustrating a relationship between accumulated supplied-developer amount and patch image forming interval.

As illustrated in FIG. 15, the CPU 201 makes the frequency of forming the patch image higher at a second amount of developer of the developing apparatus 4 than that at a first amount of developer larger than the second amount. That is, when the accumulated supplied-developer amount H_s is small (the amount of developer of the developing apparatus 4 is small), the frequency of forming the patch image becomes high. In other words, when an image is successively formed on sheets, and when the patch image is formed by the developing apparatus 4 every time the image is formed on a predetermined number of sheets, the CPU 201 controls forming of the patch image, as follows. That is, the CPU 201 controls forming of the patch image so that the predetermined number of image-formed sheets is a first number of image-formed sheets in a period of time from when the use of the developing apparatus 4 is started, until when the amount of developer of the developing apparatus 4 reaches a set value which is larger than the amount of initial developer of the developing apparatus 4 obtained before the developing apparatus 4 is used. In addition, the CPU 201 controls forming of the patch image so that the predetermined number of image-formed sheets is a second number of image-formed sheets which is larger than the first number of image-formed images, after the amount of developer of the developing apparatus 4 reaches the set value. If $H_s \geq 300$ g (S2: No), the CPU 201 sets 250 to T_p (S4).

As described above, the CPU 201 adjusts the amount of toner to be supplied to the developer container 41, by controlling (adjusting) the rotation time of the motor 49*a*. Since the rotation time of the motor 49*a* corresponds to the number of rotations of the supplying screw 4*h*, the accumulated supplied-developer amount H_s can be calculated from the rotation time of the motor 49*a*. That is, when the number of rotations of the supplying screw 4*h* reaches a predetermined value, the amount of developer of the developing apparatus 4 reaches the set value. The number of rotations of the supplying screw 4*h* may correspond not to the rotation time of the motor 49*a*, but to the number of rotations of the motor 49*a*. Here, the information on the amount of developer of the developing apparatus 4 may be the rotation time of the motor 49*a*.

Thus, in the present embodiment, when the amount of developer of the developing apparatus 4 is small, the frequency of forming the patch image is changed in accordance with the amount of developer, and thereby the amount of charge of the toner of the developing apparatus 4 can be detected at high frequency and optimized. As a result, there can be suppressed defective images which are easily produced when the amount of developer of the developing apparatus 4 is small. For example, unstable image density, toner fly, fogged white, and rough image can be suppressed. That is, the defective images can be suppressed in accordance with the amount of developer of the developing apparatus 4.

In the present embodiment, the accumulated supplied-developer amount H_s is used as information on the amount of developer of the developing apparatus 4, for determining the frequency of forming the patch image. The present disclosure, however, is not limited to this. For example, a video count value may be used as information on the amount of developer of the developing apparatus 4. The video count value is a value obtained by totalizing levels (for example, each level has a value of 0 to 255) of the pixels of an image of inputted image data. Since the amount of developer to be supplied can be estimated from image information such as the video count value, the same effects can be produced even when the frequency of forming the patch image is determined by using the video count value.

In addition, in a case where an image forming apparatus has a supplying mechanism to supply only the carrier, the frequency of forming the patch image may be determined by using the amount of supplied carrier because the amount of developer of the developing apparatus 4 can be estimated by using the amount of supplied carrier.

In addition, in the present embodiment, the developer is discharged when the amount of developer of the developing apparatus 4 is 150 g or more. Here, a slight amount of developer (for example, about 30 mg/min or less) may leak even when the amount of developer of the developing apparatus 4 is less than 150 g. Such slight leakage of the developer is not regarded as the discharge of the developer.

Second Embodiment

Next, a second embodiment will be described with reference to FIGS. 1 to 9, and FIGS. 16 to 19. The second embodiment differs from the first embodiment in that the frequency of forming the patch image is changed even when the amount of developer of the developing apparatus 4 is larger than the amount of developer obtained when the auto carrier refresh mechanism 43 starts to discharge the developer. Since the other configuration and operation are the same as those of the first embodiment, duplicated description and illustration will be omitted or simplified, and different features from the first embodiment will be mainly described.

As in the first embodiment, in the present embodiment, the amount of initial developer of the developing apparatus 4 is about 120 g, and the auto carrier refresh mechanism 43 of the developing apparatus 4 starts to discharge the developer when the amount of developer of the developing apparatus 4 reaches 150 g. Here, when the image forming operation is continued after the start of the discharging, the amount of developer (carrier) discharged from the developing apparatus 4 per unit time may be smaller than the amount of carrier supplied per unit time. For example, this case may occur when a solid image is successively formed on sheets. The solid image is an image formed in a predetermined-size image forming area at an image ratio (print ratio) of 100%.

In this case, the amount of developer of the developing apparatus 4 increases. When the solid image, for which the amount of carrier supplied per unit time is maximum, is successively formed on sheets, the amount of developer increases up to 180 g. This is because, when the amount of developer is 180 g, the supply speed of the carrier supplied when the solid image is successively formed on sheets becomes substantially equal to the discharge speed of the developer. Thus, in the present embodiment, the maximum amount of developer (predetermined amount of developer), up to which the frequency of forming the patch image is increased, is 180 g.

That is, in the present embodiment, the frequency of forming the patch image is changed in accordance with the amount of developer of the developing apparatus 4 when the amount of developer of the developing apparatus 4 is in a range from 120 to 150 g as in the first embodiment, and also when the amount of developer of the developing apparatus 4 is in a range from 150 to 180 g. Specifically, the frequency of forming the patch image is increased as the amount of developer of the developing apparatus 4 decreases. Hereinafter, the detailed description thereof will be made.

Figure 16:
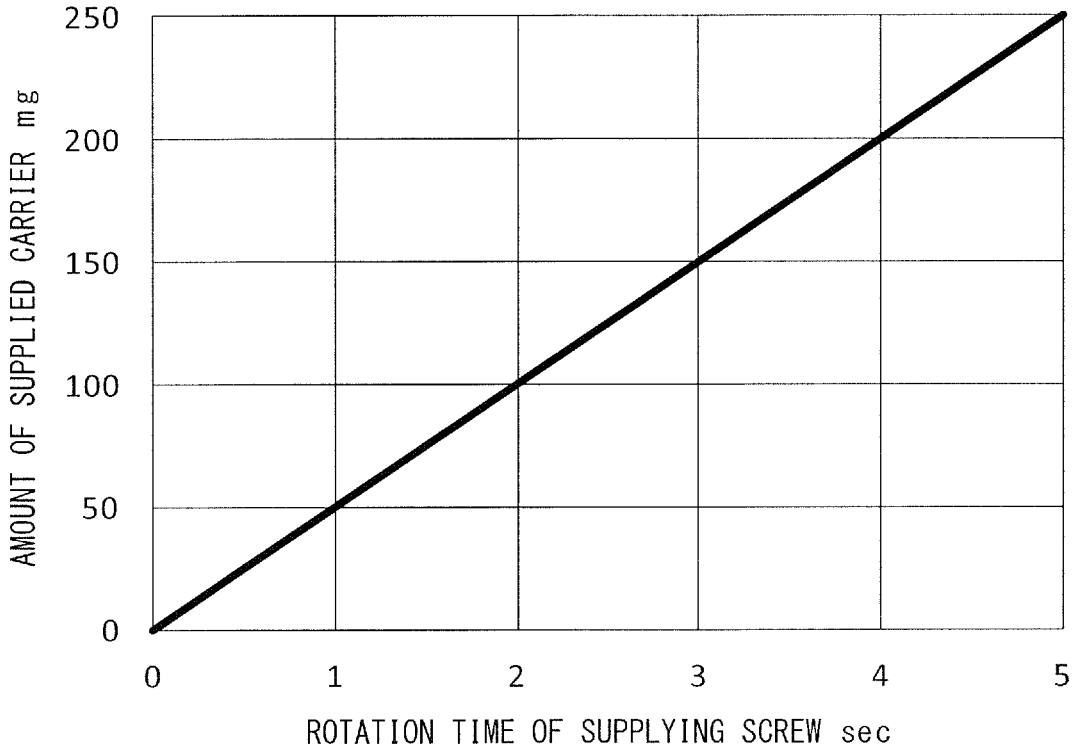
FIG. 16 is a graph illustrating a relationship of a second embodiment, between supplying-screw rotation time and carrier supply amount.
Figure 17:
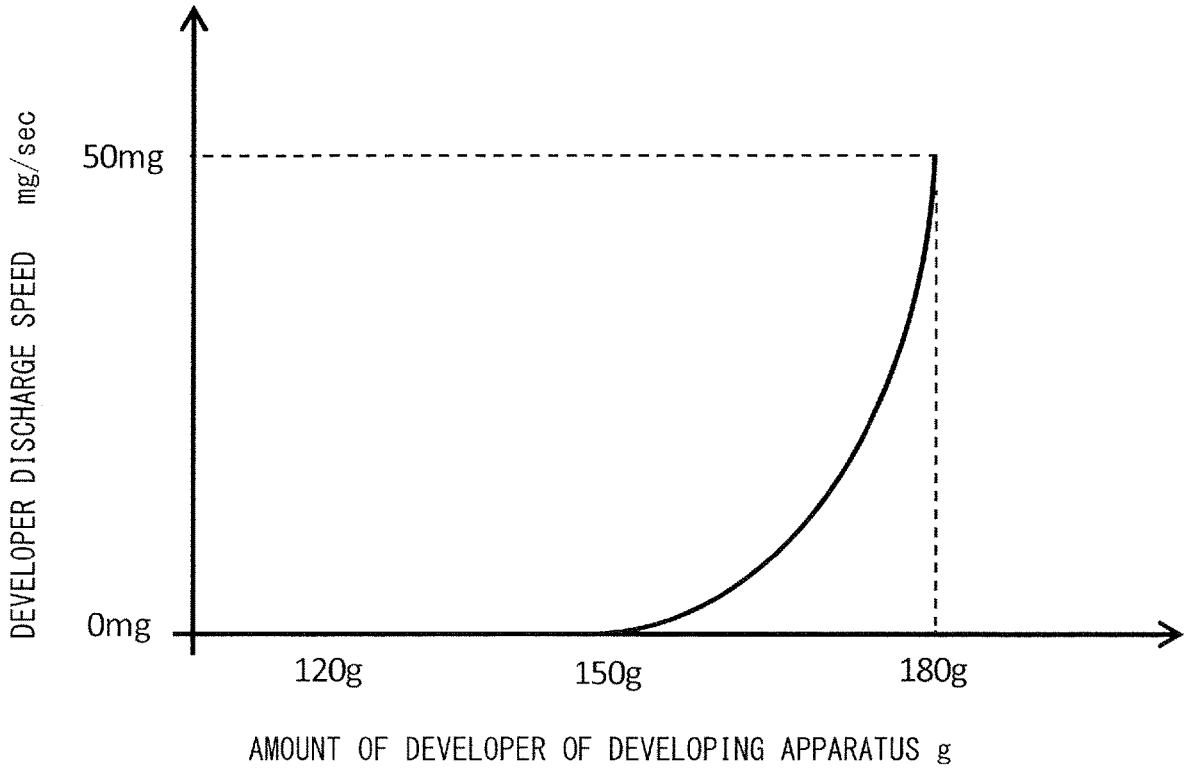
FIG. 17 is a graph illustrating a relationship of the second embodiment, between the amount of developer of the developing apparatus and developer discharge speed.

FIG. 16 illustrates a relationship between the rotation time of the supplying screw 4*h* (FIG. 3) and the amount of supplied carrier. By using the table of FIG. 16, the amount of supplied carrier can be calculated from the rotation time of the supplying screw 4*h*. FIG. 17 illustrates a relationship between the amount of developer of the developing apparatus 4 and the speed of the developer discharged from the developing apparatus 4 by the auto carrier refresh mechanism 43. By using the table of FIG. 17, the developer discharge speed can be calculated from the amount of developer.

Thus, by using FIGS. 16 and 17, the amount of carrier supplied per unit time and the amount of carrier discharged from the developing apparatus 4 can be determined, and thereby the amount M_a of developer of the developing apparatus 4 can be calculated. When the amount of developer is in a range from 120 to 150 g, the amount of discharged developer is zero as in the first embodiment, and the amount of supplied carrier calculated by using FIG. 16 is added to the amount M_a of developer. In the present embodiment, the amount M_a of developer calculated by using the tables of FIGS. 16 and 17 is the information on the amount of developer of the developing apparatus 4.

Here, one example for calculating the amount of developer of the developing apparatus 4 will be described. For example, suppose that the amount of developer of the developing apparatus 4 is 170 g at a predetermined time. Then, an image forming operation is performed. In the image forming operation, the developing apparatus 4 is operated for 10 seconds, and the supplying screw 4*h* is rotated for 5 seconds. In this case, by using FIG. 16, the amount of supplied carrier obtained when the supplying screw 4*h* is rotated for 5 seconds is calculated as 250 mg; and by using the table of FIG. 17, the developer discharge amount obtained when the developing apparatus 4 contains 170 g of the developer and is operated for 10 seconds is calculated as 180 mg. Thus, since the difference 70 mg between the amount of supplied carrier 250 mg and the amount of discharged developer 180 mg is added to 170 g, the amount M_a of developer of the developing apparatus 4 obtained after the image forming job is completed is calculated as 170.07 g.

Figure 18:
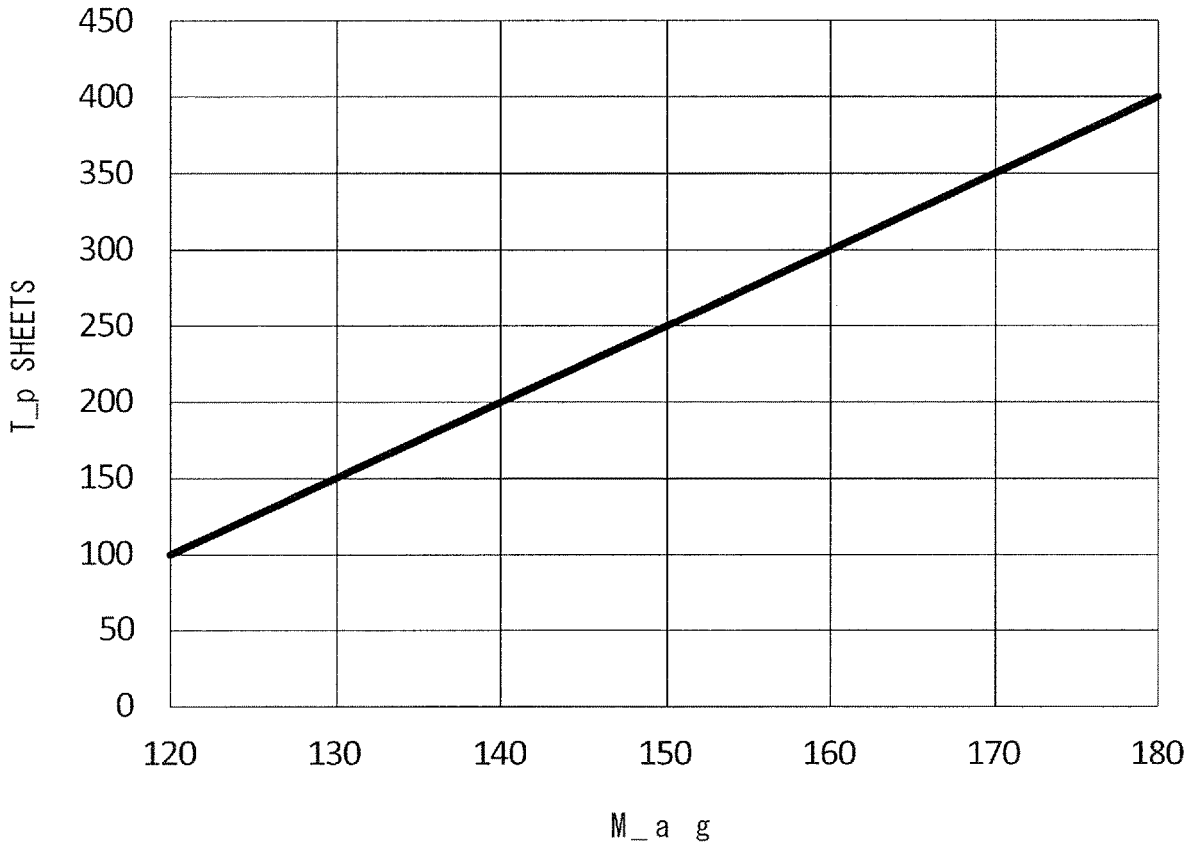
FIG. 18 is a graph illustrating a relationship of the second embodiment, between the amount of developer of the developing apparatus and patch image forming interval.
Figure 19:
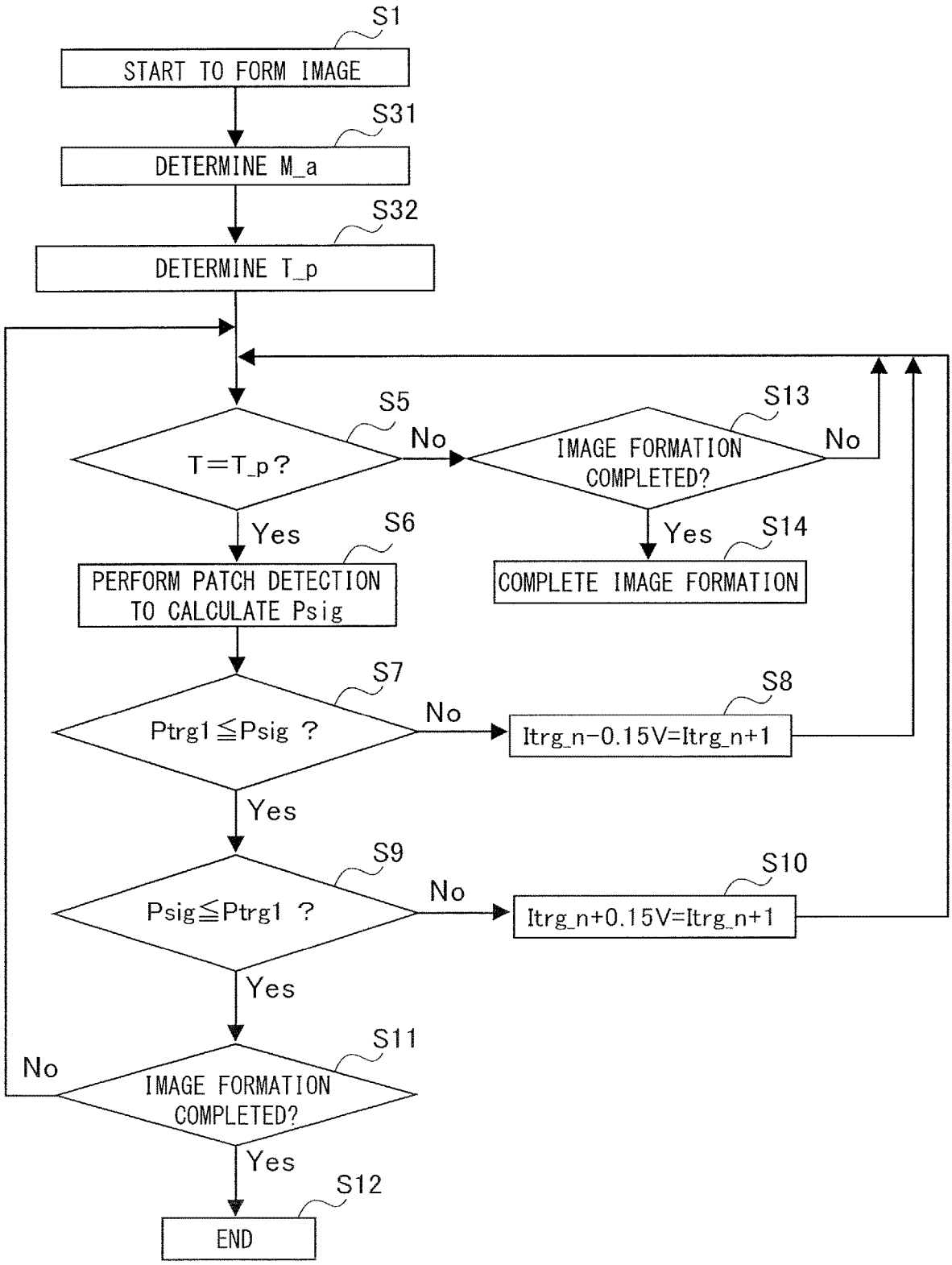
FIG. 19 is a flowchart illustrating induction-detection toner supply control of the second embodiment.

Next, developer supplying control of the present embodiment will be described with reference to FIGS. 18 and 19. FIG. 19 is a flowchart illustrating processes from the start to the end of an image forming operation. Here, symbols used in FIG. 19 are the same as those used in FIG. 13. Also in the present embodiment, the target toner-image-density value Ptrg1 is 500, and the number of image-outputted sheets produced by using the developing apparatus 4 is calculated by the CPU 201, and stored in the memory 202 included in or connected to the CPU 201.

After starting to form an image (S1), the CPU 201 refers to the tables of FIGS. 16 and 17, and calculates the amount M_a of developer of the developing apparatus 4 (S31). The CPU 201 then uses the table of FIG. 18, and determines T_p (S32). As illustrated in FIG. 18, the CPU 201 makes the frequency of forming the patch image, higher at a second amount of developer of the developing apparatus 4 than that at a first amount of developer larger than the second amount. The steps S5 to S14 are the same as the steps S5 to S14 of FIG. 13 of the first embodiment.

In the present embodiment, even when the amount of developer (carrier) discharged from the developing apparatus 4 per unit time is smaller than the amount of carrier supplied per unit time, for example, when a solid image is successively formed on sheets, defective images can be prevented from occurring.

Third Embodiment

Next, a third embodiment will be described with reference to FIGS. 1 to 9, and FIGS. 20 and 21. The third embodiment differs from the first embodiment in that the laser power (exposure amount) of the exposure apparatus 3 is controlled in the image forming operation in accordance with the patch image density (detection result) detected by the image density sensor 90. Since the other configuration and operation are the same as those of the first embodiment, duplicated description and illustration will be omitted or simplified, and different features from the first embodiment will be mainly described.

In the first embodiment, the target value of the inductance detection signal is corrected in accordance with the patch image density detected by the image density sensor 90, to suppress change in the amount of charge of the toner and change in the image density. In the present embodiment, the laser power of the exposure apparatus 3 is corrected as appropriate in the image forming operation in accordance with the patch image density (detection result) detected by the image density sensor 90, to suppress change in the image density caused by change in the amount of charge of the toner. Hereinafter, detailed description thereof will be made.

Also in the present embodiment, a predetermined reference latent image (patch latent image) is formed on the photosensitive drum 1 when no image is formed, and then a patch image (control toner image, or reference toner image) is formed on the photosensitive drum 1 by developing the predetermined reference latent image under a predetermined developing condition. The patch image is then transferred onto the intermediate transfer belt 51, and the density of the patch image is detected by the image density sensor 90.

The image density sensor 90 sends a density signal indicating a patch image density (the amount of sticking toner), to the CPU 201 (FIG. 9). The CPU 201 compares the density signal from the image density sensor 90, with an initial reference signal pre-stored in the CPU 201; and performs later-described control, in accordance with a comparison result. The CPU 201 reads a predetermined environment table (which stores set values for process conditions based on temperature and humidity information and set values for process conditions such as exposure intensity, developing bias, and transfer bias) stored in the ROM 202*a* when the image forming apparatus 100 was installed. The charged photosensitive drum 1 is exposed to the laser beam in accordance with this table, to form the patch latent image; and the patch image is formed by developing the patch latent image.

Next, the laser power control in the present embodiment will be described with reference to FIG. 20. As previously described, the amount of charge of the toner of the developer changes due to long-term use, continuous use, change in use condition, and the like. In this case, even though the toner density is kept constant, it may be difficult to keep stable image density and color. Thus, in the present embodiment, the laser power of the exposure apparatus 3 is controlled as appropriate in the image forming operation in accordance with the patch image density detected by the image density sensor 90. Since the exposure is performed with the laser power determined in accordance with the change in the amount of charge of the toner, an image having appropriate image density is outputted.

Figure 20:
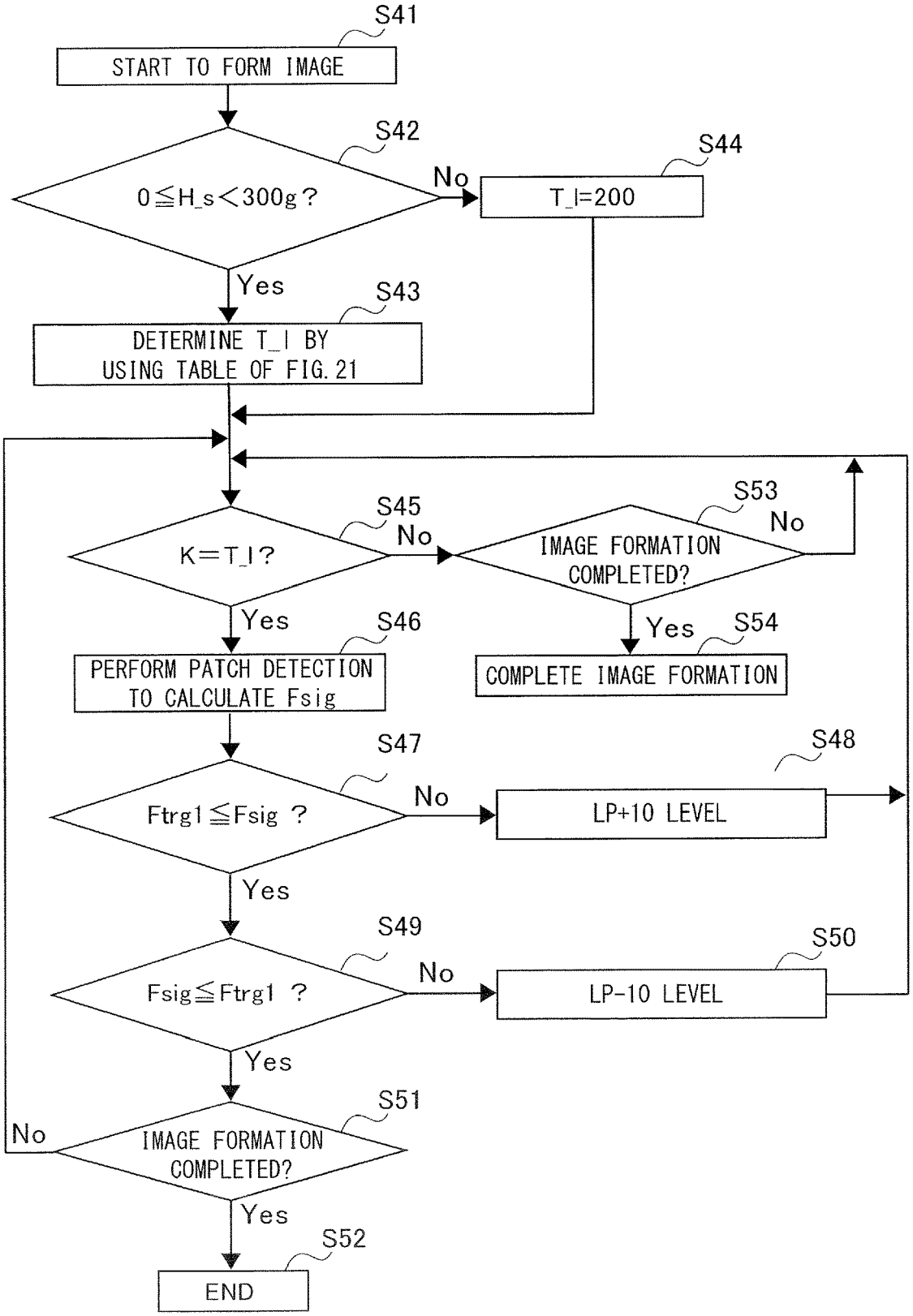
FIG. 20 is a flowchart illustrating laser power control of a third embodiment, performed for an exposure apparatus by using patch detection.

In FIG. 20, a symbol K denotes the number of image-outputted sheets (the number of image-formed sheets) counted from when a patch image was formed in the last time by using the developing apparatus 4, a symbol T_1 denotes the number of sheets (frequency) which causes the patch image to be formed, and a symbol Ftrg1 denotes a target toner-image-density value (a target signal value) of the patch image. The target toner-image-density value Ftrg1 of the present embodiment is 500. A symbol Fsig denotes an image-density signal value of the patch image, and a symbol LP denotes a laser power of the exposure apparatus 3. The minimum level of the laser power is 128, and the maximum level of the same is 255. In the present embodiment, the number of image-outputted sheets produced by using the developing apparatus 4 is calculated by the CPU 201 and stored in the memory 202 included in or connected to the CPU 201.

After starting to form an image (S41), the CPU 201 determines T_1 in steps S42 to S44. The steps S42 to S44 will be described later. The CPU 201 then determines whether the number K of image-outputted sheets counted from when a patch image was formed in the last time reaches T_1 (S45). If the number K of image-outputted sheets reaches T_1 in S45 (S45: Yes), then the CPU 201 forms a patch image, causes the image density sensor 90 to detect the density of the patch image, and calculates the image density Fsig (S46).

The CPU 201 then determines whether the relationship between the detected image density Fsig of the patch image and the target toner-image-density value Ftrg1 satisfies Ftrg1≤Fsig (S47). If the relationship does not satisfy Ftrg1≤Fsig, that is, if Ftrg1>Fsig (S47: No), the laser power (exposure amount) LP of the exposure apparatus 3 is changed (S48). Specifically, the level of the laser power LP of the exposure apparatus 3 is increased by 10 (S48).

When the image density Fsig of the patch image is lower than the target toner-image-density value Ftrg1, the amount of charge of the toner of the developing apparatus 4 is large. Thus, the laser power LP is increased, so that an image having a desired density is obtained even when the amount of charge of the toner is large. That is, when the laser power LP is increased, a potential difference (developing contrast) between a potential of an exposed portion of the photosensitive drum 1 and a direct-current voltage (developing potential) of developing bias of the developing apparatus 4 becomes large. Consequently, the image density can be increased even when the image density is low due to the large amount of charge of the toner.

In contrast, if the relationship satisfies Ftrg1≤Fsig in S47 (S47: Yes), then the CPU 201 determines whether the relationship between the patch image density Fsig and the target toner-image-density value Ftrg1 satisfies Fsig≤Ftrg1 (S49). If the relationship does not satisfy Fsig≤Ftrg1 in S49, that is, if Fsig>Ftrg1 (S49: No), the laser power (exposure amount) LP of the exposure apparatus 3 is changed (S50). Specifically, the level of the laser power LP of the exposure apparatus 3 is decreased by 10 (S50).

When the image density Fsig of the patch image is higher than the target toner-image-density value Ftrg1, the amount of charge of the toner of the developing apparatus 4 is small. Thus, the laser power LP is decreased, so that an image having a desired density is obtained even when the amount of charge of the toner is small. That is, when the laser power LP is decreased, the developing contrast is decreased. Consequently, the image density can be decreased even when the image density is high due to the small amount of charge of the toner.

As described above, in the setting of the laser power of the present embodiment, the minimum level is 128 and the maximum level is 255. Thus, when the corrected value of the laser power becomes larger than 255 or smaller than 128, the corrected value will be fixed to 255 or 128.

If the relationship satisfies Fsig≤Ftrg1 in S49 (S49: Yes), then the CPU 201 determines whether the image forming operation is completed (S51). The CPU 201 ends the image forming process (S52) if the image forming operation is completed (S51: Yes) or returns to S45 if not (S51: No). Here, when the relationship satisfies Ftrg1≤Fsig in S47, and Fsig≤Ftrg1 in S49, Fsig is equal to Ftrg1. In this case, since the laser power (exposure amount) LP needs not to be changed, the image forming operation will be continued with the same laser power (exposure amount) LP.

If the number K of image-outputted sheets counted from when a patch image was formed in the last time by using the developing apparatus 4 does not reach T_1 in S45 (S45: No), then the CPU 201 determines whether the image forming operation is completed (S53). The CPU 201 ends the image forming process (S54) if the image forming operation is completed (S53: Yes) or returns to S45 if not (S53: No).

Frequency of Forming Patch Image

Next, a method of the present embodiment to determine the number of image-formed sheets which causes the patch image to be formed will be described with reference to S42 to S44 of FIG. 20, and FIG. 21. Also in the present embodiment, the ratio of the toner to the carrier of the supplying developer is 9:1. Thus, after the initializing operation of the developing apparatus 4 is completed and the image forming operation is started, the amount of developer of the developing apparatus 4 reaches 150 g (predetermined amount of developer) when the supplying developer has been supplied by about 300 g.

The present embodiment also uses the accumulated supplied-developer amount H_s calculated from when the initializing operation of the developing apparatus 4 is completed, as information on the amount of developer of the developing apparatus 4; and changes the frequency of forming the patch image. In the present embodiment, the frequency of forming the patch image corresponds to the number of image-formed sheets which causes the patch image to be formed. Specifically, as illustrated in FIG. 20, after starting to form an image (S41), the CPU 201 determines whether 0≤H_s<300 g is satisfied (S42). If 0≤H_s<300 g is satisfied (S42: Yes), then the CPU 201 determines the number T_1 of image-formed sheets which causes the patch image to be formed (that is, patch image forming interval), depending on the table of FIG. 21 (S43).

Figure 21:
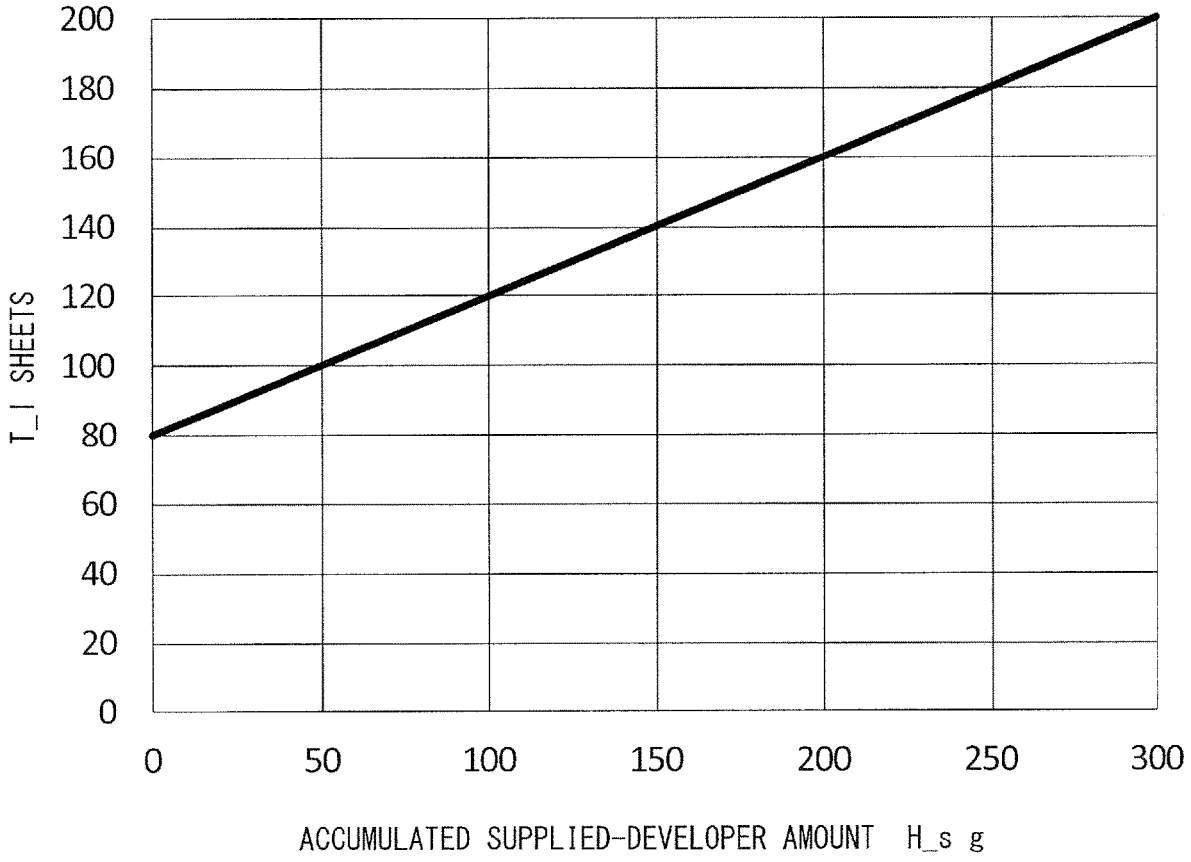
FIG. 21 is a graph illustrating a relationship of the third embodiment, between accumulated supplied-developer amount and patch image forming interval.

As illustrated in FIG. 21, the CPU 201 makes the frequency of forming the patch image, higher at a second amount of developer of the developing apparatus 4 than that at a first amount of developer larger than the second amount. That is, when the accumulated supplied-developer amount H_s is small (the amount of developer of the developing apparatus 4 is small), the frequency of forming the patch image becomes high. In other words, when an image is successively formed on sheets, and when the patch image is formed by the developing apparatus 4 every time the image is formed on a predetermined number of sheets, the CPU 201 controls forming of the patch image, as follows. That is, the CPU 201 controls forming of the patch image so that the predetermined number of image-formed sheets is a first number of image-formed sheets in a period of time from when the use of the developing apparatus 4 is started, until when the amount of developer of the developing apparatus 4 reaches a set value which is larger than the amount of initial developer of the developing apparatus 4 obtained before the developing apparatus 4 is used. In addition, the CPU 201 controls forming of the patch image so that the predetermined number of image-formed sheets is a second number of image-formed sheets which is larger than the first number of image-formed images, after the amount of developer of the developing apparatus 4 reaches the set value. If H_s≥300 g (S42: No), the CPU 201 sets 200 to T_1 (S44).

Thus, in the present embodiment, when the amount of developer of the developing apparatus 4 is small, the frequency of forming the patch image is changed in accordance with the amount of developer, and thereby the laser power of the exposure apparatus 3 is changed as appropriate. With this operation, the change in image density, caused by the change in the amount of charge of the toner, can be suppressed. That is, the defective images can be suppressed in accordance with the amount of developer of the developing apparatus 4.

Fourth Embodiment

Next, a fourth embodiment will be described with reference to FIGS. 1 to 9, FIGS. 16 and 17, and FIGS. 22 and 23. The fourth embodiment differs from the third embodiment in that the frequency of forming the patch image is changed even when the amount of developer of the developing apparatus 4 is larger than the amount of developer obtained when the auto carrier refresh mechanism 43 starts to discharge the developer. Since the other configuration and operation are the same as those of the third embodiment, duplicated description and illustration will be omitted or simplified, and different features from the third embodiment will be mainly described.

Also in the present embodiment, the maximum amount of developer (predetermined amount of developer), up to which the frequency of forming the patch image is increased, is 180 g as in the second embodiment. That is, in the present embodiment, the frequency of forming the patch image is changed to adjust the laser power of the exposure apparatus 3, when the amount of developer of the developing apparatus 4 is in a range from 120 to 150 g as in the first embodiment, and also when the amount of developer of the developing apparatus 4 is in a range from 150 to 180 g. Specifically, the frequency of forming the patch image is increased as the amount of developer of the developing apparatus 4 decreases. Hereinafter, the detailed description thereof will be made.

Also in the present embodiment, by using FIGS. 16 and 17, the amount of carrier supplied per unit time and the amount of carrier discharged from the developing apparatus 4 can be determined, and thereby the amount M_a of developer of the developing apparatus 4 can be calculated. When the amount of developer is in a range from 120 to 150 g, the amount of discharged developer is zero as in the first embodiment, and the amount of supplied carrier calculated by using FIG. 16 is added to the amount of developer.

Figure 22:
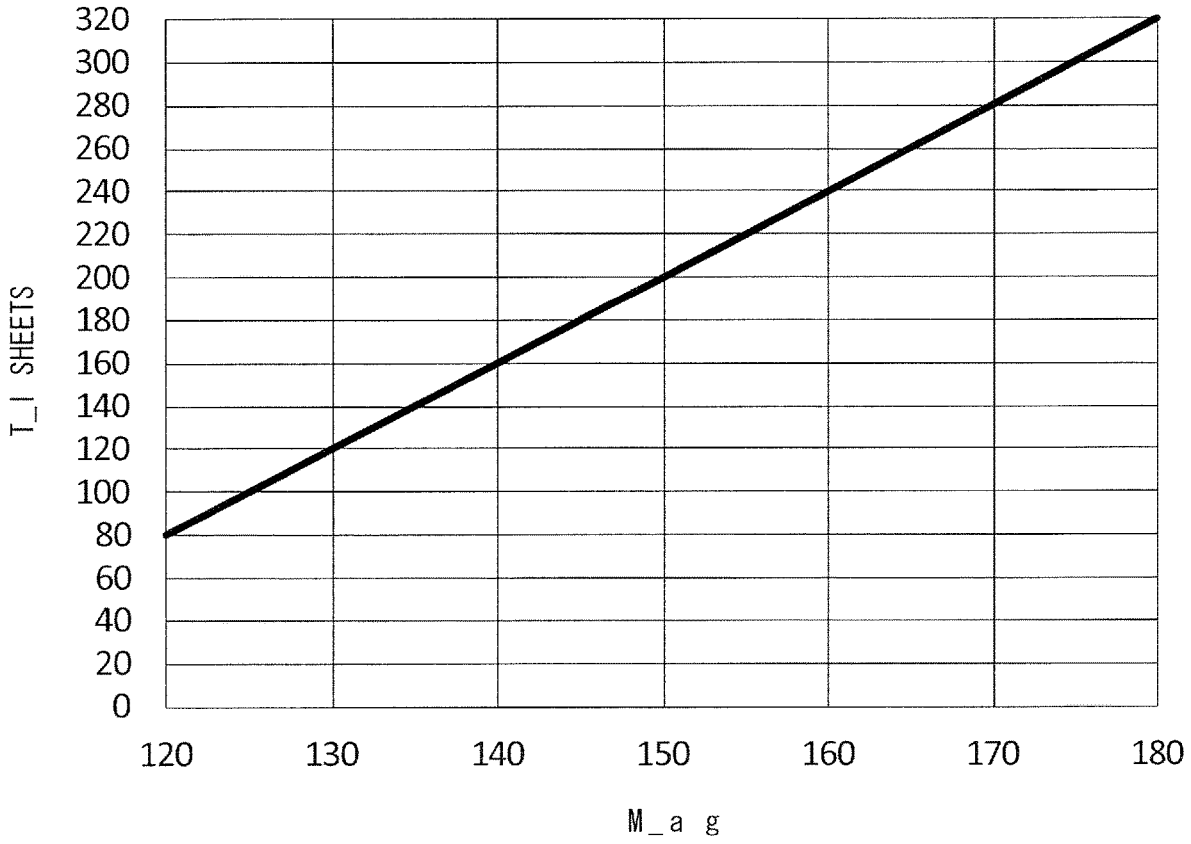
FIG. 22 is a graph illustrating a relationship of a fourth embodiment, between the amount of developer of the developing apparatus and patch image forming interval.
Figure 23:
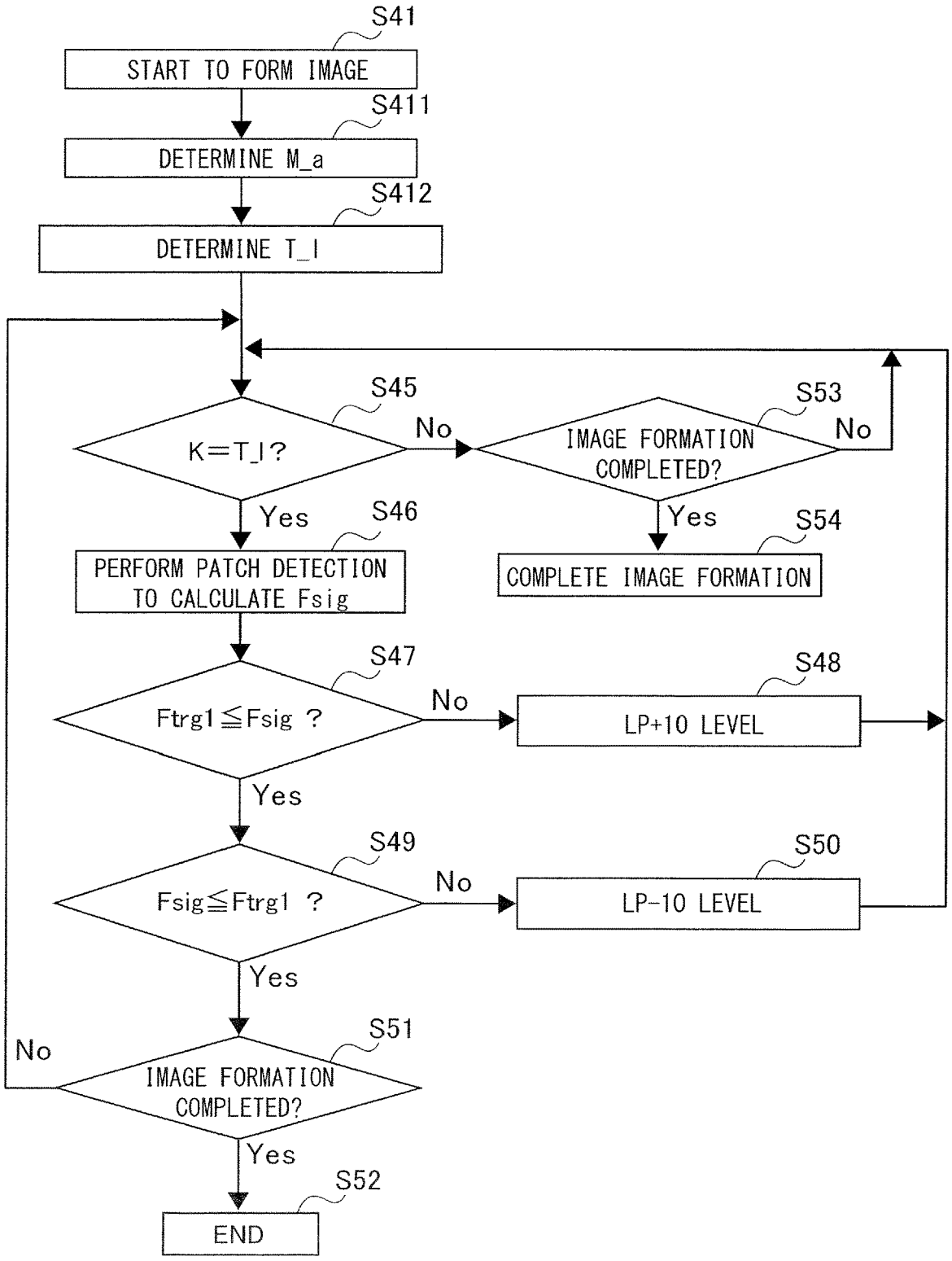
FIG. 23 is a flowchart illustrating laser power control of the fourth embodiment, performed for an exposure apparatus by using patch detection.

Next, the laser power control of the present embodiment will be described with reference to FIGS. 22 and 23. Here, symbols used in FIG. 23 are the same as those used in FIG. 20. Also, in the present embodiment, the target toner-image-density value Ftrg1 is 500, the minimum level of the laser power is 128, and the maximum level of the same is 255. In addition, the number of image-outputted sheets produced by using the developing apparatus 4 is calculated by the CPU 201 and stored in the memory 202 included in or connected to the CPU 201.

After starting to form an image (S41), the CPU 201 refers to the tables of FIGS. 16 and 17 and calculates the amount M_a of developer of the developing apparatus 4 (S411). Then the CPU 201 determines T_1 by using the table of FIG. 22 (S412). As illustrated in FIG. 22, the CPU 201 makes the frequency of forming the patch image, higher at a second amount of developer of the developing apparatus 4 than that at a first amount of developer larger than the second amount.

The steps S45 to S54 are the same as the steps S45 to S54 of FIG. 20 of the third embodiment.

In the present embodiment, even when the amount of developer (carrier) discharged from the developing apparatus 4 per unit time is smaller than the amount of carrier supplied per unit time, for example, when a solid image is successively formed on sheets, defective images can be prevented from occurring.

Fifth Embodiment

Next, a fifth embodiment will be described with reference to FIGS. 1 to 9, and FIGS. 24 to 26. The fifth embodiment differs from the first embodiment in that the developer is forced to be consumed in a developer replacement mode, and that the amount of developer forced to be consumed is determined depending on an average image ratio and the accumulated supplied-developer amount H_s. Since the other configuration and operation are the same as those of the first embodiment, duplicated description and illustration will be omitted or simplified, and different features from the first embodiment will be mainly described.

In general, when an image for which the toner is less consumed (that is, image having a low image ratio) is successively formed on sheets, the toner of the developing apparatus 4 is hardly replaced. The toner will stay and circulate in the developing apparatus 4 for a long time. If the toner stays in the developing apparatus 4 for a long time, the toner will be repeatedly rubbed and agitated in the developing apparatus 4 for the long time and charged up. In addition, the shape of toner particles will become uneven, and the additive added to the developer for increasing flowability of the developer will be buried in surfaces of the toner particles. As a result, defective images will be easily produced. For example, developing performance by the toner is decreased, transfer efficiency is decreased, the image density is decreased, and rough images are produced.

Such problems are significantly produced particularly when the amount of toner (or developer) of the developing apparatus 4 is small. This is because, if the toner of the developing apparatus 4 is circulated in the developing apparatus 4 for a long time without consumed, the toner will highly likely exist on a place, such as the developing sleeve, where the toner will easily deteriorate.

To solve such problems, in the present embodiment, the CPU 201 which serves as a discharging control portion can perform a developer replacement mode in which the developer is discharged. That is, the CPU 201 calculates an image ratio of an image which is being formed and performs the developer replacement mode when detecting that the calculated image ratio is smaller than a predetermined value. Thus, in the developer replacement mode, the developer of the developing apparatus 4 is forced to be consumed, and the supplying developer is supplied to the developing apparatus 4 by the developer supplying mechanism 49.

Specifically, an electrostatic latent image formed on a non-image area is developed by using a predetermined amount of toner to consume the toner of the developing apparatus 4, and the supplying toner is newly supplied to the developing apparatus 4 by the amount of consumed toner by the developer supplying mechanism 49, so that the deteriorated toner is replaced with the new toner. With such control, when an image having a low image ratio is successively formed on sheets, the decrease in image quality and image density caused by the non-replaced toner of the developing apparatus 4 can be prevented.

Here, in the present embodiment, when the amount of developer of the developing apparatus 4 is small, the amount of toner to be replaced is increased to optimize the image quality. The image forming apparatus of the present embodiment uses a so-called video counting method, which can estimate the amount of toner to be consumed, by using a video count value of the image density of an image signal having been read by a CCD or the like. That is, a video count value of a single document is determined by detecting a level of each pixel of an output signal from an image signal processing circuit and totalizing detected values of the pixels that define the size of the document sheet. For example, the maximum video count value for a single A4-size sheet is 3884×106 in 400 dpi and 256-step gradation. The average image ratio can be calculated by multiplying the video count value by the number of image-formed sheets.

Developer Replacement Mode

Next, the developer replacement mode will be described in detail below. In the present embodiment, when an image having a low image ratio is successively formed on sheets, the toner is forced to be consumed to replace the toner, for preventing deterioration of the toner and image quality. The flow of the control will be described with reference to FIGS. 24 and 25.

After starting to form an image (S61), the CPU 201 determines, in S62 to S64, a threshold m (%) of the average image ratio used for determining whether to perform the developer replacement mode. The steps S62 to S64 will be described later. The CPU 201 then reads inputted image data, calculates an image ratio of the image by using its video count value, and stores the image ratio in the ROM 202*a*. The ROM 202*a* sequentially stores images ratios of previously-read one-hundred images (or previously-read predetermined number of images) including the image ratio of the image data. The CPU 201 reads the image ratios of the previously-read one-hundred images from the ROM 202*a* and calculates an average image ratio n (%) of the previously-read one-hundred images (S65). Here, the average image ratio of the predetermined number of images (100 images in the present embodiment) corresponds to an average image ratio of toner images formed while the developing apparatus 4 has been driven for a predetermined period of time. Thus, the average image ratio may be calculated not by using the number of image-formed sheets, but by using the period of time in which the developing apparatus 4 has been driven.

The CPU 201 determines whether the average image ratio n (%) calculated in S65 is smaller than the threshold m (%) determined in S63 (S66). If the CPU 201 determines in S66 that the average image ratio n (%) is smaller than the threshold m (%) (S66: Yes), the CPU 201 calculates a toner replacement amount X (mg) (S67). Then the CPU 201 forces a predetermined amount of toner to be consumed and forces the supplying toner to be supplied (that is, the CPU 201 performs the developer replacement mode) (S68).

Figure 25:
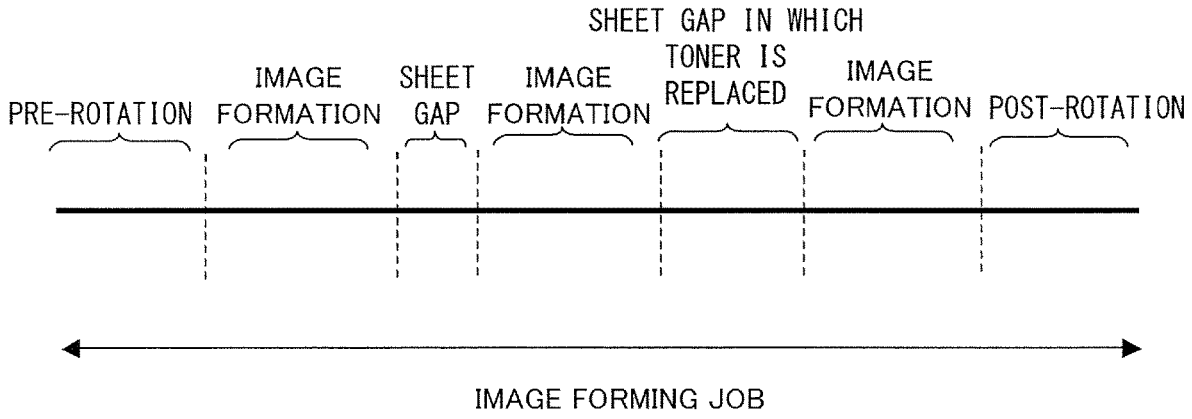
FIG. 25 is a diagram illustrating an operation process of the image forming apparatus, of the fifth embodiment.

In the present embodiment, to consume the toner by the amount determined by using the average image ratio m (%), a non-image area of the photosensitive drum 1 (which is a paper-sheet gap portion as illustrated in FIG. 25, in the present embodiment) is irradiated with the laser beam to form an electrostatic latent image, and the electrostatic latent image is developed. The non-image area extends across the surface of the photosensitive drum 1 in the axial direction and is irradiated with the laser beam by an amount FFH of irradiation. Thus, since the toner image is formed on the paper-sheet gap portion, the toner image on the paper-sheet gap portion will not be transferred onto a recording material.

In this manner, the toner of the developing apparatus 4 is forced to be consumed. The amount of toner to be consumed is adjusted by changing a length of the non-image area of the photosensitive drum 1 in the rotational direction of the photosensitive drum 1.

The toner replacement amount X (mg) is calculated as follows. When the amount of toner to be consumed for a single A4-size solid image (having an image ratio of 100%) is 400 mg, the toner replacement amount X is calculated by using the following equation (1), $$X\ (\text{mg})=400\ (\text{mg})\times[(m-n)/100]\times 100 \quad (1)$$

where X is a toner replacement amount, m (%) is a threshold of the average image ratio used for determining whether to perform the toner replacing operation, and n (%) is an average image ratio.

The toner image developed in the developer replacement mode is all removed by the cleaning apparatus 7, without transferred onto the intermediate transfer belt 51. In addition, while or after the toner is consumed, the supplying toner is supplied to the developing apparatus 4 by the developer supplying mechanism 49, by the same amount as that of consumed toner. In this manner, the toner of the developing apparatus 4 is replaced to optimize the flowability of the toner and the amount of charge of the toner.

Figure 24:
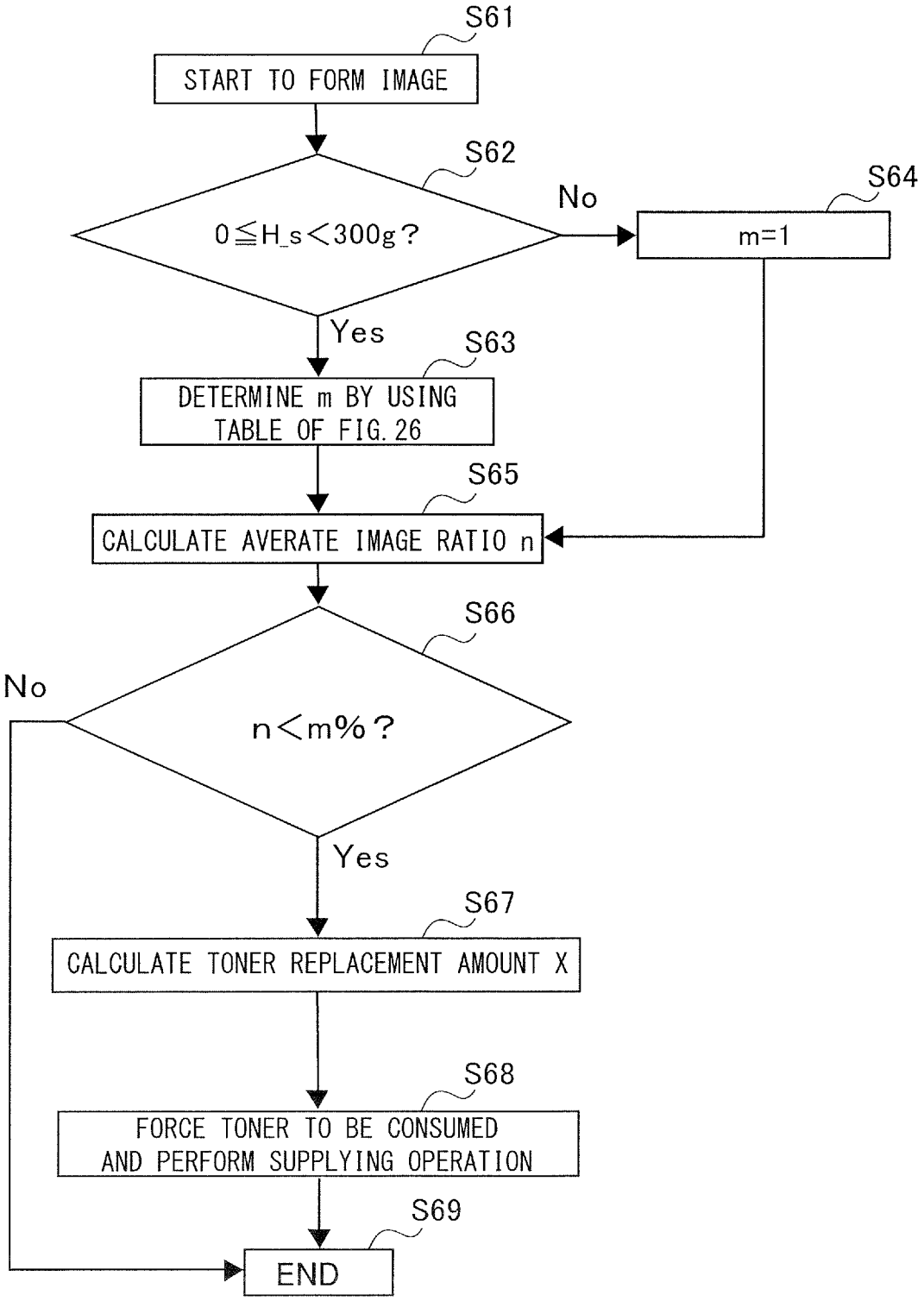
FIG. 24 is a flowchart illustrating a developer replacement mode of a fifth embodiment, performed by using average image ratio.

Here, a method of the present embodiment to determine the threshold m (%) of the average image ratio used for determining whether to perform the developer replacement mode will be described with reference to the steps S62 to S64 of FIG. 24, and FIG. 26. Also in the present embodiment, the ratio of the toner to the carrier of the supplying developer is 9:1. Thus, after the initializing operation of the developing apparatus 4 is completed and the image forming operation is started, the amount of developer of the developing apparatus 4 reaches 150 g (predetermined amount of developer) when the supplying developer has been supplied by about 300 g.

Thus, the present embodiment uses the accumulated supplied-developer amount H_s calculated from when the initializing operation of the developing apparatus 4 is completed, as information on the amount of developer of the developing apparatus 4; and determines the threshold m (%). Specifically, as illustrated in FIG. 24, after starting to form an image (S61), the CPU 201 which serves also as a determination portion determines whether 0≤H_s<300 g is satisfied (S62). If 0≤H_s<300 g is satisfied (S62: Yes), then the CPU 201 uses the table of FIG. 26 and determines the threshold m (%) of the average image ratio used for determining whether to perform the developer replacement mode (S63).

Figure 26:
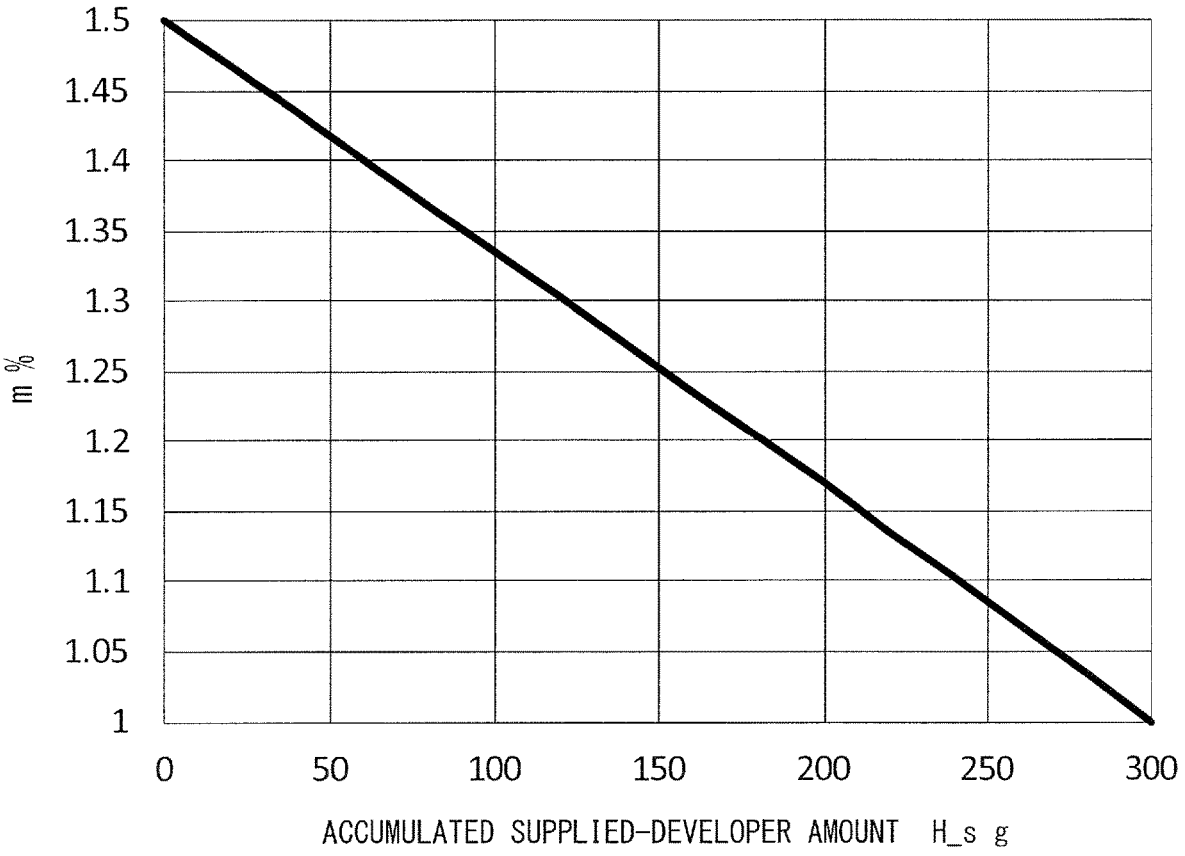
FIG. 26 is a graph illustrating a relationship of the fifth embodiment, between accumulated supplied-developer amount and threshold of the average image ratio used for determining whether to perform the developer replacement mode.

As illustrated in FIG. 26, the CPU 201 makes the threshold m (%) larger at a second amount of developer of the developing apparatus 4 than that at a first amount of developer larger than the second amount. That is, when the accumulated supplied-developer amount H_s is small (the amount of developer of the developing apparatus 4 is small), the threshold m (%) becomes large. That is, when an image having an image ratio smaller than a predetermined value is successively formed on sheets, and when a discharging operation to discharge the developer from the developing sleeve 44 is performed every time the image is formed on a predetermined number of sheets, the CPU 201 controls the discharging operation to the developer as follows. That is, the CPU 201 controls the discharging operation to the developer so that the amount of discharged developer in the discharging operation is a first discharged amount in a period of time from when the use of the developing apparatus 4 is started, until when the amount of developer of the developing apparatus 4 reaches a first developer amount which is larger than the amount of initial developer of the developing apparatus 4 obtained before the developing apparatus 4 is used. In addition, the CPU 201 controls the discharging operation to the developer so that the amount of discharged developer in the discharging operation is a second discharged amount which is smaller than the first discharged amount, when the amount of developer of the developing apparatus 4 is a second developer amount larger than the first developer amount after reaching the first developer amount. If H_s≥300 g (S62: No), the CPU 201 sets 1% to m (%) (S64).

In the above-described equation (1), if the amount of developer of the developing apparatus 4 is constant, the amount of developer forced to be consumed in the developer replacement mode and obtained when the average image ratio n (%) is a first ratio is larger than that obtained when the average image ratio n (%) is a second ratio smaller than the first ratio. That is, if the threshold m (%) is constant (the amount of developer of the developing apparatus 4 is constant), the amount of developer forced to be consumed in the developer replacement mode increases as the average image ratio n (%) decreases.

On the other hand, if the average image ratio n (%) is constant, the amount of developer forced to be consumed in the developer replacement mode and obtained when the amount of developer of the developing apparatus 4 is a first amount is larger than that obtained when the amount of developer is a second amount smaller than the first amount. That is, if the average image ratio n (%) is constant, the amount of developer forced to be consumed in the developer replacement mode increases as the threshold m (%) increases (the amount of developer of the developing apparatus 4 decreases).

Here, the amount of developer forced to be consumed in the developer replacement mode, obtained in a period of time from when the seals 46 are removed and the use of the developing apparatus 4 is started, until when the amount of developer of the developing apparatus 4 reaches the predetermined amount of developer (0≤H_s<300 g), will be compared with the amount of developer forced to be consumed in the developer replacement mode, obtained after the amount of developer of the developing apparatus 4 reaches the predetermined amount of developer (H_s≥300 g). If the average image ratio n (%) is constant, the amount of developer obtained when 0≤H_s<300 g is larger than the amount of developer obtained when H_s≥300 g.

Thus, in the present embodiment, when the amount of developer of the developing apparatus 4 is small, and when an image having a low image ratio is successively formed on sheets, the toner replacement amount is changed in accordance with the amount of developer. As a result, there can be suppressed defective images, such as decreased toner density and rough image, which are easily produced when the amount of developer of the developing apparatus 4 is small. That is, the defective images can be suppressed in accordance with the amount of developer of the developing apparatus 4.

In the present embodiment, the toner replacement amount is increased when the amount of developer of the developing apparatus 4 is small. The present disclosure, however, is not limited to this. For example, even when a toner replacement amount per one time is not changed but the frequency of the toner replacement is increased, the same effect can be produced. That is, instead of or in addition to the operation in which the amount of developer of the developing apparatus 4 is forced to be consumed in the developer replacement mode, the frequency of the developer replacement mode may be increased. Specifically, when an image having a low image ratio smaller than a predetermined value is successively formed on sheets, the discharging operation to the developer is controlled such that a number of image-formed sheets in a period from an execution of one discharging operation to an execution of a following discharging operation is a first number of image-formed sheets during from when the use of the developing apparatus 4 is started, until when the amount of developer of the developing apparatus 4 reaches a first developer amount which is larger than the amount of initial developer of the developing apparatus 4 obtained before the developing apparatus 4 is used. In addition, when the amount of developer of the developing apparatus 4 is a second developer amount larger than the first developer amount after reaching the first developer amount, the discharging operation to the developer is controlled such that a number of image-formed sheets in a period from an execution of one discharging operation to an execution of a following discharging operation is a second number of image-formed sheets larger than the first number of image-formed sheets.

Sixth Embodiment

Next, a sixth embodiment will be described with reference to FIGS. 1 to 9, FIGS. 16 and 17, and FIGS. 27 and 28. The sixth embodiment differs from the fifth embodiment in that the toner replacement amount is changed in the developer replacement mode even when the amount of developer of the developing apparatus 4 is larger than the amount of developer obtained when the auto carrier refresh mechanism 43 starts to discharge the developer. Since the other configuration and operation are the same as those of the fifth embodiment, duplicated description and illustration will be omitted or simplified, and different features from the fifth embodiment will be mainly described.

Also in the present embodiment, the maximum amount of developer (predetermined amount of developer), up to which the toner replacement amount is increased in the developer replacement mode, is 180 g, as in the second embodiment. That is, in the present embodiment, when an image having a low image ratio is successively formed on sheets, the toner replacement amount is changed when the amount of developer of the developing apparatus 4 is in a range from 120 to 150 g as in the fifth embodiment, and also when the amount of developer of the developing apparatus 4 is in a range from 150 to 180 g. Specifically, the toner replacement amount is increased as the amount of developer of the developing apparatus 4 decreases. Hereinafter, the detailed description thereof will be made.

Also in the present embodiment, by using FIGS. 16 and 17, the amount of carrier supplied per unit time and the amount of carrier discharged from the developing apparatus 4 can be determined, and thereby the amount M_a of developer of the developing apparatus 4 can be calculated. When the amount of developer is in a range from 120 to 150 g, the amount of discharged developer is zero as in the first embodiment, and the amount of supplied carrier calculated by using FIG. 16 is added to the amount of developer.

Figure 27:
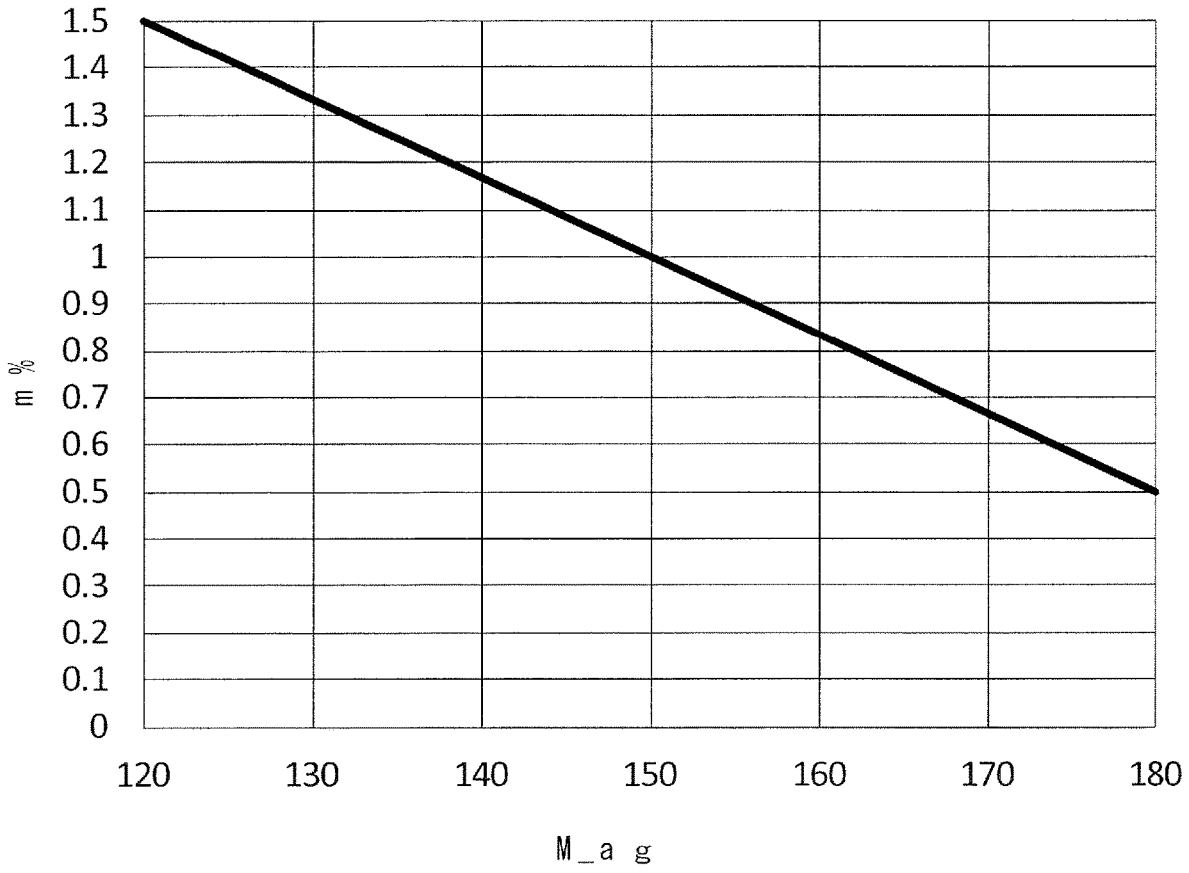
FIG. 27 is a graph illustrating a relationship of a sixth embodiment, between the amount of developer of the developing apparatus and threshold of the average image ratio used for determining whether to perform the developer replacement mode.
Figure 28:
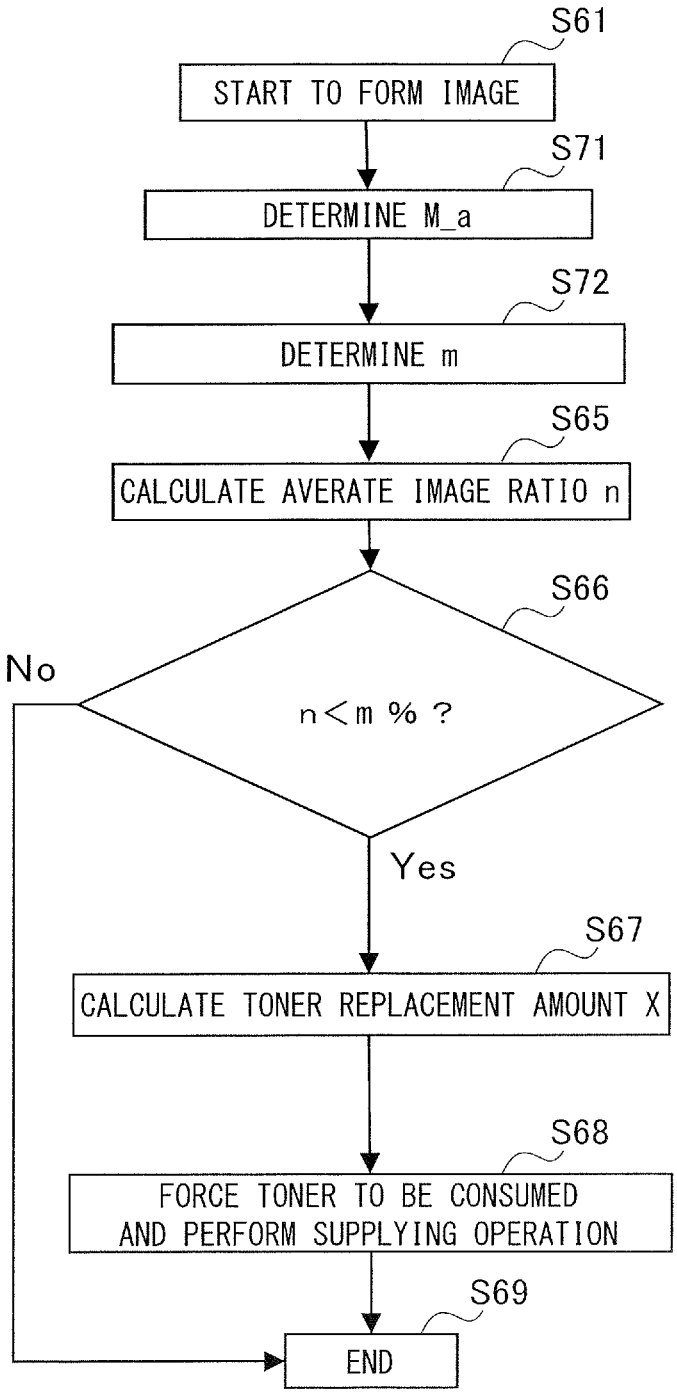
FIG. 28 is a flowchart illustrating a developer replacement mode of the sixth embodiment, performed by using the average image ratio.

Next, the developer replacement mode of the present embodiment will be described with reference to FIGS. 27 and 28. After starting to form an image (S61), the CPU 201 refers to the tables of FIGS. 16 and 17 and calculates the amount M_a of developer of the developing apparatus 4 (S71). Then the CPU 201 determines the threshold m (%) by using the table of FIG. 27 (S72). As illustrated in FIG. 27, the CPU 201 makes the threshold m (%) larger at a second amount of developer of the developing apparatus 4 than that at a first amount of developer larger than the second amount. The steps S65 to S69 are the same as the steps S65 to S69 of FIG. 24 of the fifth embodiment.

In the present embodiment, even when the amount of developer (carrier) discharged from the developing apparatus 4 per unit time is smaller than the amount of carrier supplied per unit time, for example, when a solid image is successively formed on sheets, defective images can be prevented from occurring.

Seventh Embodiment

Next, a seventh embodiment will be described with reference to FIGS. 1 to 9, and FIGS. 29 and 30. The seventh embodiment differs from the first embodiment in that an idling-mode time is provided and determined by using a toner supply amount Q_t and the accumulated supplied-developer amount H_s. The toner supply amount Q_t is the amount of toner continuously supplied at one time and will be described later. Since the other configuration and operation are the same as those of the first embodiment, duplicated description and illustration will be omitted or simplified, and different features from the first embodiment will be mainly described.

In general, when an image having a high image ratio is successively formed on sheets, a large amount of toner is consumed, and thus a large amount of supplying toner is supplied to the developing apparatus 4. In this time, since the supplied toner is not sufficiently charged, toner fog, toner fly, and increased image density may occur. These problems frequently occur when the amount of developer of the developing apparatus 4 is small, because the amount of carrier to charge the supplied toner is decreased.

To solve these problems, a method of the present embodiment stops the image forming operation and performs an idling operation (idling mode) of the developing apparatus 4, when the supplying toner is supplied by a predetermined amount or more at one time. With this method, the supplied toner is circulated and charged in the developing apparatus 4. In the idling mode, the agitating-and-conveying screws 41*d* and 41*e* are driven, in an extended predetermined period of time, without forming an electrostatic latent image on the photosensitive drum 1. With such control, when an image having a high image ratio is successively formed on sheets, toner fog, toner fly, and increased image density due to insufficient charge of toner of the developing apparatus 4 can be prevented.

In the present embodiment, the idling mode is performed when the amount of developer of the developing apparatus 4 is small. The detailed description thereof will be described with reference to FIGS. 29 and 30.

Figure 29:
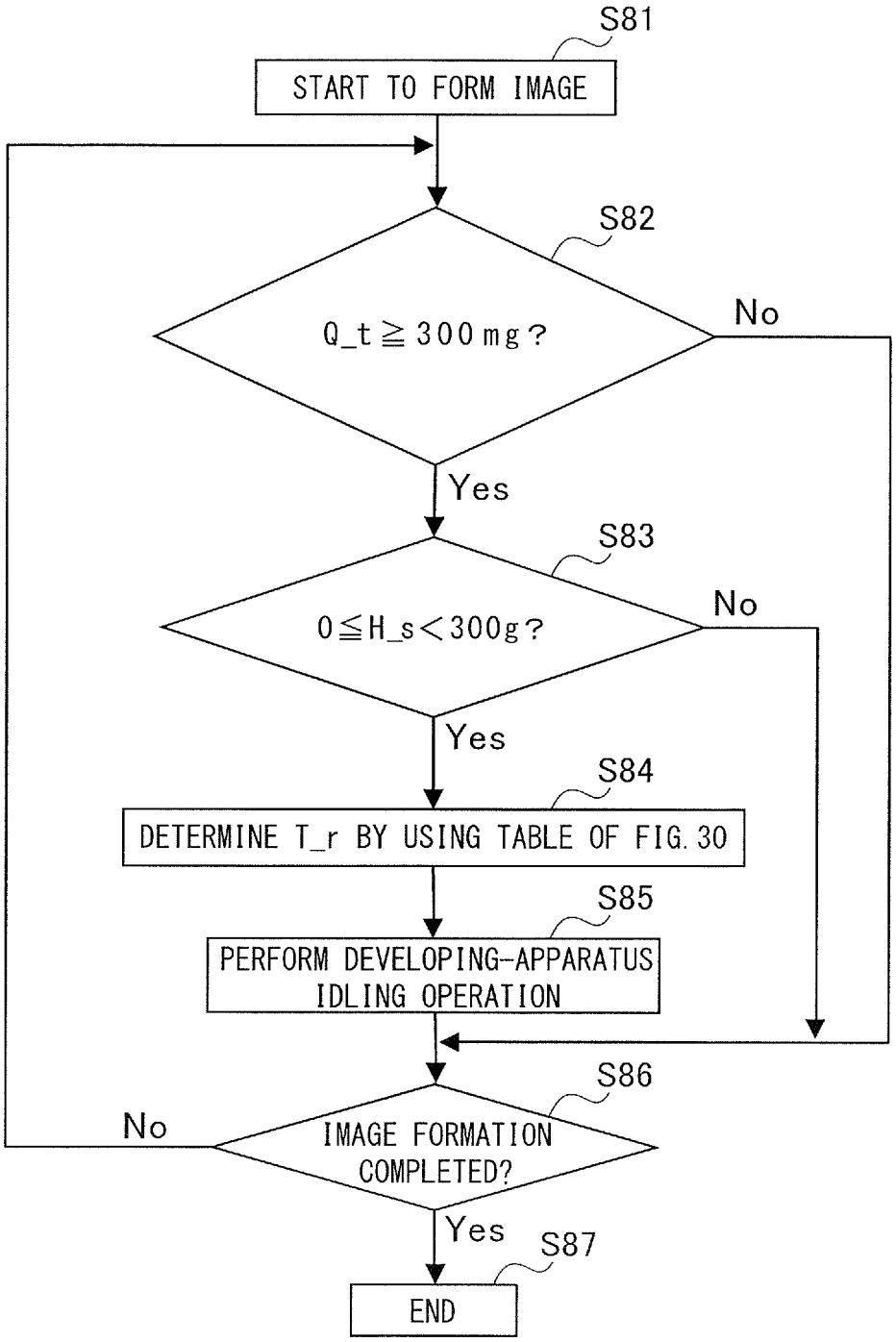
FIG. 29 is a flowchart illustrating an idling mode of a seventh embodiment, performed by using accumulated supplied-developer amount.

As illustrated in the flowchart of FIG. 29, after starting to form an image (S81), the CPU 201 which serves as a control portion determines whether the toner supply amount Q_t of toner, which has been continuously supplied at one time, satisfies Q_t≥300 mg (S82). That is, the CPU 201 determines whether the amount Q_t of supplied developer, continuously supplied by the developer supplying mechanism 49, is equal to or larger than a predetermined amount (300 mg). In the present embodiment, the amount Q_t is the amount of developer continuously supplied at one time. The amount Q_t corresponds to the amount of developer supplied through a single supplying operation. Here, even when the supplying developer is supplied intermittently within a predetermined period of time (for example, within a period of time in which the developer makes one revolution in the developer container 41, or within a paper-sheet gap time), the amount Q_t is regarded as the amount of continuously supplied developer if the supplied developer does not circulate sufficiently in the developer container 41. If Q_t≥300 mg in S82 (S82: Yes), the CPU 201 uses the table of FIG. 30, and determines a developing-apparatus idling time (extended time) T_r (sec) in the steps S83 and S84. The steps S83 and S84 will be described later.

Then, the CPU 201 causes the developing apparatus 4 to perform the idling operation (idling mode) (S85). In the present embodiment, the idling operation of the developing apparatus 4 is performed in a predetermined period of time in which no image is formed (the period of time corresponds to a paper-sheet gap portion in the present embodiment). That is, the predetermined period of time corresponds to a portion between successive recording materials, and the time T_r determined in S84 is obtained by extending the paper-sheet gap time. Then the CPU 201 determines whether the image forming operation is completed and ends this process (S87) if the image forming operation is completed (S86: Yes).

Here, a method of the present embodiment to determine the developing-apparatus idling time T_r (sec) will be described with reference to the steps S83 and S84 of FIG. 29, and FIG. 30. Also in the present embodiment, the ratio of the toner to the carrier of the supplying developer is 9:1. Thus, after the initializing operation of the developing apparatus 4 is completed and the image forming operation is started, the amount of developer of the developing apparatus 4 reaches 150 g (predetermined amount of developer) when the supplying developer has been supplied by about 300 g.

Thus, the present embodiment uses the accumulated supplied-developer amount H_s calculated from when the initializing operation of the developing apparatus 4 is completed, as information on the amount of developer of the developing apparatus 4; and determines the developing-apparatus idling time T_r. Specifically, as illustrated in FIG. 29, the CPU 201 which serves also as a determination portion determines whether 0≤H_s<300 g is satisfied (S83). If 0≤H_s<300 g is satisfied (S83: Yes), the CPU 201 uses the table of FIG. 30 and determines the developing-apparatus idling time T_r (sec).

Figure 30:
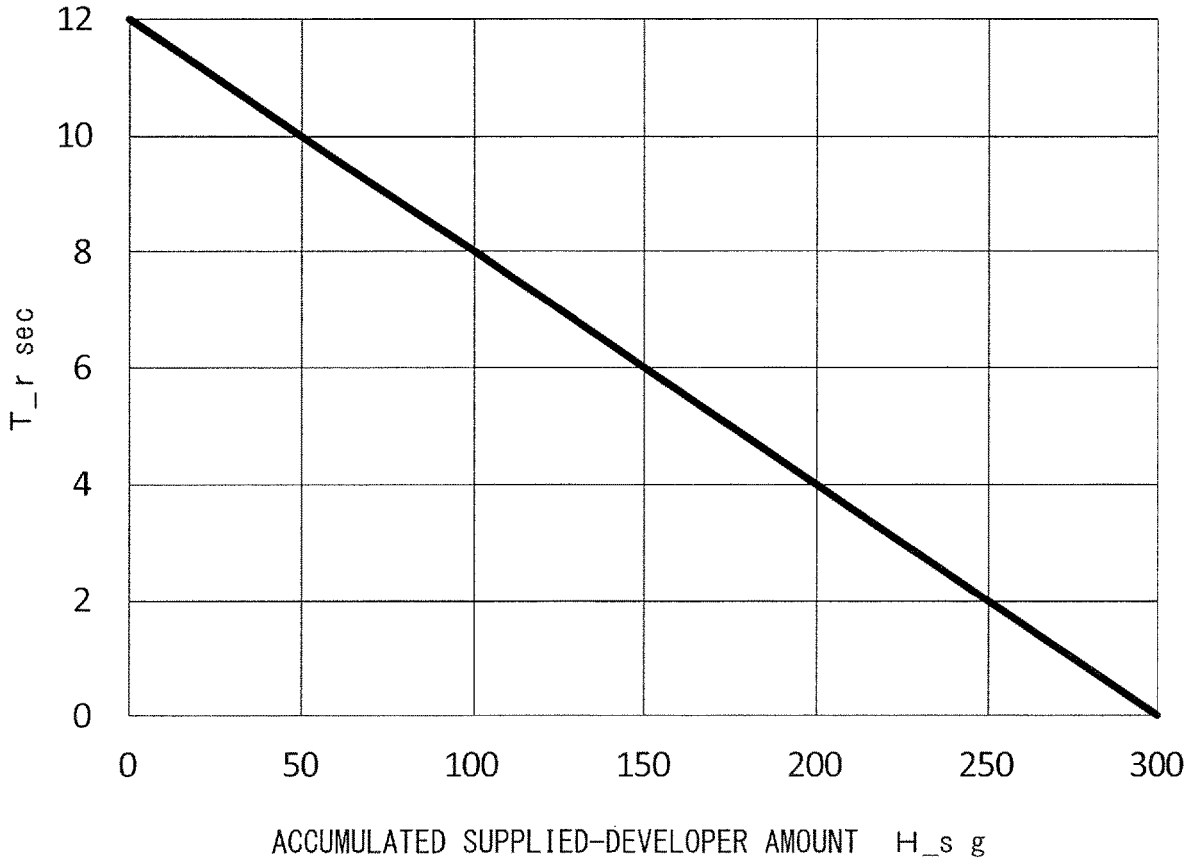
FIG. 30 is a graph illustrating a relationship of the seventh embodiment, between accumulated supplied-developer amount and idling-mode time.

As illustrated in FIG. 30, the CPU 201 makes the developing-apparatus idling time T_r (sec) longer at a second amount of developer of the developing apparatus 4 than that at a first amount of developer larger than the second amount. That is, when the accumulated supplied-developer amount H_s is small (the amount of developer of the developing apparatus 4 is small), the developing-apparatus idling time T_r (sec) becomes long. On the other hand, if H_s≥300 g (S83: No), then the developing-apparatus idling operation is not performed (T_r=0). Thus, the CPU 201 determines the developing-apparatus idling time T_r, in accordance with the accumulated supplied-developer amount H_s, in a period of time from when the seals 46 are removed and the use of the developing apparatus 4 is started, until when the amount of developer of the developer container 41 reaches the predetermined amount of developer (0≤H_s<300 g). In other words, in a period of time from when the use of the developing apparatus 4 is started, until when the amount of developer of the developing apparatus 4 reaches the predetermined amount of developer which is larger than the amount of initial developer obtained before the developing apparatus 4 is used, when the supplying developer is supplied by a predetermined amount or more through a single supplying operation in the image forming operation, the CPU 201 stops the image forming operation and drives the agitating-and-conveying screws 41*d* and 41*e* for a predetermined time, that is, causes the developing apparatus 4 to perform the idling operation. After the amount of developer of the developing apparatus 4 reaches the predetermined amount of developer, when the supplying developer is supplied by the predetermined amount or more through a single supplying operation in the image forming operation, the CPU 201 continues the image forming operation without stopping it.

Thus, in the present embodiment, when the amount of developer of the developing apparatus 4 is small, the developing-apparatus idling time is changed in accordance with the amount of developer if the supplying toner is supplied by a predetermine amount or more. As a result, there can be suppressed defective images, such as decreased toner density and rough image, which are easily produced when the amount of developer of the developing apparatus 4 is small. That is, the defective images can be suppressed in accordance with the amount of developer of the developing apparatus 4.

Eighth Embodiment

Next, an eighth embodiment will be described with reference to FIGS. 1 to 9, FIGS. 16 and 17, and FIGS. 31 and 32. The eighth embodiment differs from the seventh embodiment in that the developing-apparatus idling time T_r (extended time) is changed even when the amount of developer of the developing apparatus 4 is larger than the amount of developer obtained when the auto carrier refresh mechanism 43 starts to discharge the developer. Since the other configuration and operation are the same as those of the seventh embodiment, duplicated description and illustration will be omitted or simplified, and different features from the seventh embodiment will be mainly described.

Also in the present embodiment, the maximum amount of developer (predetermined amount of developer), up to which the developing-apparatus idling time T_r is changed, is 180 g, as in the second embodiment. That is, in the present embodiment, the developing-apparatus idling time T_r, in which the idling operation is performed when the supplying toner is supplied by a predetermined amount or more per one time, is changed in accordance with the amount of developer when the amount of developer of the developing apparatus 4 is in a range from 120 to 150 g as in the seventh embodiment, and also when the amount of developer of the developing apparatus 4 is in a range from 150 to 180 g. Specifically, the developing-apparatus idling time T_r, in which the idling operation is performed when a larger amount of toner is supplied, is increased as the amount of developer of the developing apparatus 4 decreases. Hereinafter, the detailed description thereof will be made.

Also in the present embodiment, by using FIGS. 16 and 17, the amount of carrier supplied per unit time and the amount of carrier discharged from the developing apparatus 4 can be determined, and thereby the amount of developer of the developing apparatus 4 can be calculated. When the amount of developer is in a range from 120 to 150 g, the amount of discharged developer is zero as in the first embodiment, and the amount of supplied carrier calculated by using FIG. 16 is added to the amount of developer.

Figure 31:
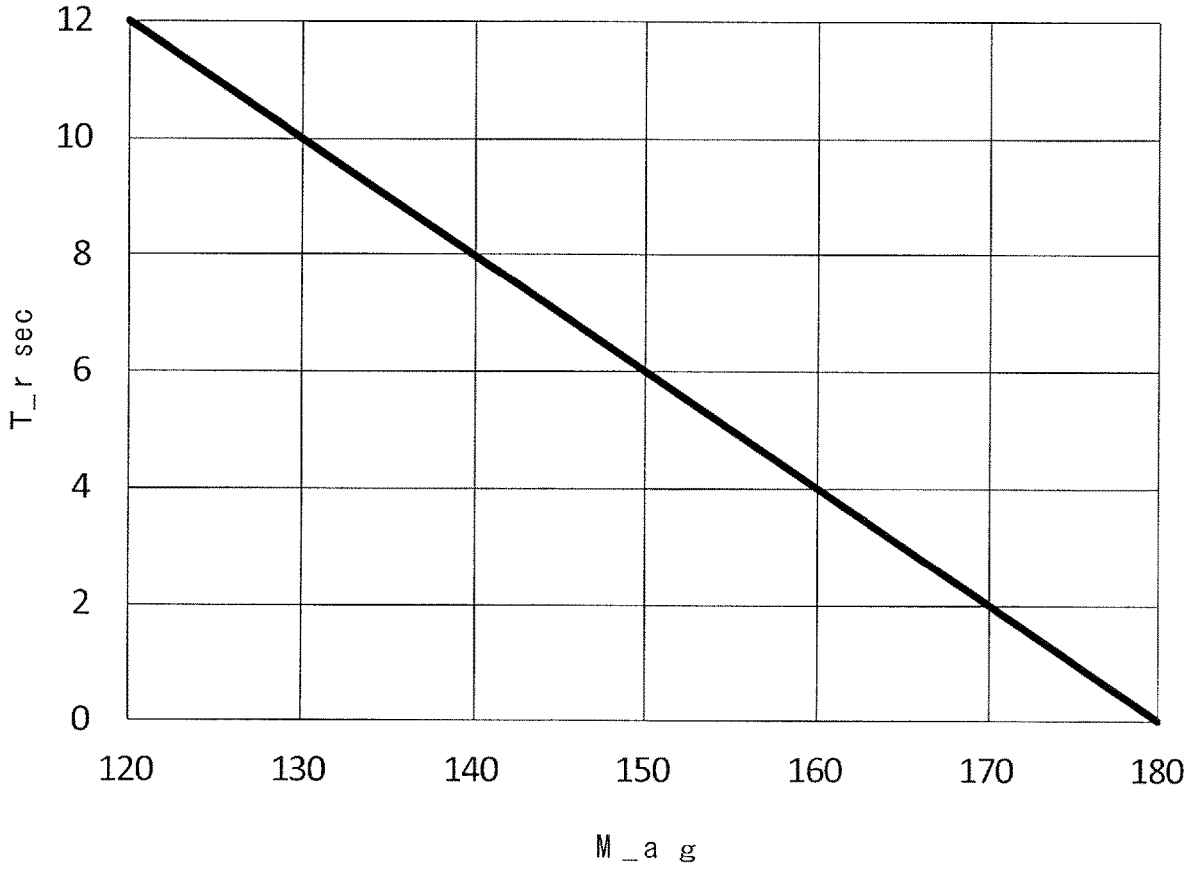
FIG. 31 is a graph illustrating a relationship of an eighth embodiment, between the amount of developer of the developing apparatus and idling-mode time.
Figure 32:
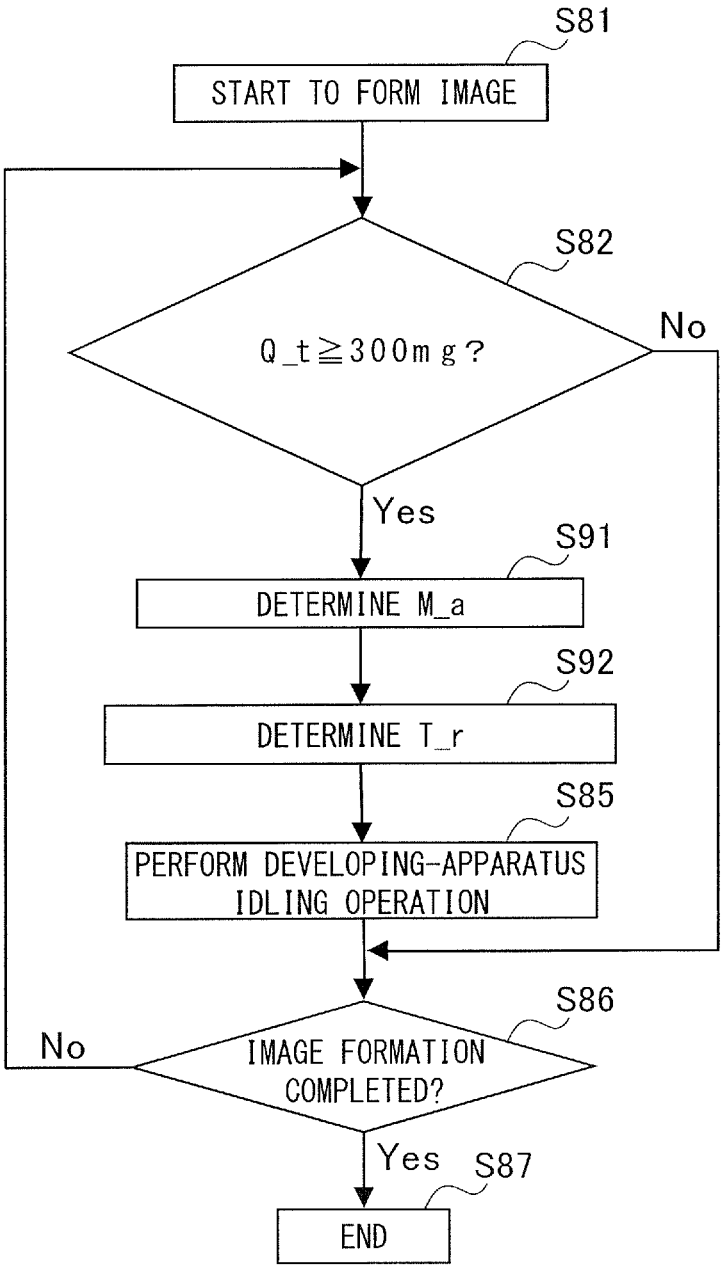
FIG. 32 is a flowchart illustrating an idling mode of the eighth embodiment, performed by using the amount of developer of the developing apparatus.

Next, the idling mode of the present embodiment will be described with reference to FIGS. 31 and 32. After starting to form an image (S81), the CPU 201 determines whether the toner supply amount Q_t of developer, which has been continuously supplied at one time, satisfies Q_t≥300 mg (S82). If Q_t≥300 mg is satisfied in S82 (S82: Yes), the CPU 201 refers to the tables of FIGS. 16 and 17 and calculates the amount M_a of developer of the developing apparatus 4 (S91). Then the CPU 201 determines the developing-apparatus idling time T_r (sec) by using the table of FIG. 31 (S92). As illustrated in FIG. 31, the CPU 201 makes the developing-apparatus idling time T_r longer at a second amount of developer of the developing apparatus 4 than that at a first amount of developer larger than the second amount. The steps S85 to S87 are the same as the steps S85 to S87 of FIG. 29 of the seventh embodiment.

In the present embodiment, even when the amount of developer (carrier) discharged from the developing apparatus 4 per unit time is smaller than the amount of carrier supplied per unit time, for example, when a solid image is successively formed on sheets, defective images can be prevented from occurring.

Other Embodiments

The above-described embodiments may be combined with each other as appropriate. For example, the control for the developer supply amount, performed in the first or the second embodiment by detecting the patch image, may be combined with the control for the amount of exposure, performed in the third or the fourth embodiment by the exposure apparatus. In addition, the control performed in any one of the first to the fourth embodiments may be added with the control performed in the developer replacement mode in the fifth or the sixth embodiment. In addition, the control performed in any one of the first to the sixth embodiments may be added with the control of the idling mode in the seventh or the eighth embodiment.

In the above-described embodiments, the supplying screw is used. The present invention, however, is not limited to this. That is, the supplying developer may be directly supplied from the developer supplying container to the developing apparatus 4. In this case, the number of rotations (or rotation time) of the developer supplying container is counted, and when the number of rotations reaches a predetermined value, it may be regarded that the amount of developer of the developing apparatus 4 reaches a predetermined amount.

The present invention may be applied not only for printers, but also for image forming apparatuses, such as copying machines, facsimiles, and multifunction printers having a plurality of functions of these products. In addition, the present invention may be applied not only for full-color-image forming apparatuses, but also for monochrome-image forming apparatuses used for forming monochrome images.

In the above-described embodiments, the description has been made for the intermediate-transfer image forming apparatus in which a toner image is transferred onto the intermediate transfer belt from the photosensitive drum. The present invention, however, may be applied for a direct-transfer image forming apparatus in which a toner image is directly transferred onto a recording material from a photosensitive drum. In this case, the image density sensor 90 serving as a density detecting portion is disposed so as to detect a toner image formed on the photosensitive drum.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-035074, filed Feb. 28, 2018, which is hereby incorporated by reference herein in its entirety.

What is claimed is:

1. An image forming apparatus comprising:

an image bearing member;

a developing apparatus configured to contain developer including toner and carrier, and develop an electrostatic latent image formed on the image bearing member, by using the developer, the developer being enclosed in the developing apparatus by a seal member before use of the developing apparatus is started, the developing apparatus comprising a discharging portion for discharging the developer from the developing apparatus;

a developer bearing member disposed in the developing apparatus and configured to bear and convey the developer;

a conveyance portion disposed in the developing apparatus and configured to circulate the developer in the developing apparatus;

a developer supplying container configured to contain supplying developer to be supplied to the developing apparatus;

a supplying portion configured to supply the supplying developer from the developer supplying container to the developing apparatus; and a control portion, wherein in a first period from when use of the developing apparatus is started until when an amount of the developer in the developing device reaches a predetermined amount larger than an amount of the initial developer in the developing device before use of the developing apparatus is started, in a case where an amount of the supplying developer supplied from the supplying portion through a single supplying operation in the image forming operation is larger than a predetermined supplied amount, the control portion is configured to interrupt the image forming operation and drive the conveyance portion for a predetermined time in a state that the image forming operation is interrupted, and wherein in a second period after the amount of the developer in the developing device reaches the predetermined amount, in a case where an amount of the supplying developer supplied from the supplying portion through a single supplying operation in the image forming operation is larger than the predetermined supplied amount, the control portion is configured to continue the image forming operation without interrupting the image forming operation.

2. The image forming apparatus according to claim 1, wherein the supplying portion comprises a supplying screw configured to supply the supplying developer, and wherein the amount of developer in the developing device reaches the predetermined amount in a case where a number of rotations of the supplying screw from starting use of the developing apparatus reaches a predetermined value.

3. The image forming apparatus according to claim 1, wherein the supplying portion supplies the supplying developer by rotating the developer supplying container, and wherein the amount of developer in the developing device reaches the predetermined amount in a case where a number of rotations of the developer supplying container from starting use of the developing apparatus reaches a predetermined value.

4. The image forming apparatus according to claim 1, wherein in the first period, in a case where an amount of the supplying developer supplied from the supplying portion through a single supplying operation in the image forming operation is larger than the predetermined supplied amount and the amount of the developer in the developing device is a first amount smaller than the predetermined amount, the control portion is configured to interrupt the image forming operation and drive the conveyance portion for a first time in a state that the image forming operation is interrupted, and wherein in the first period, in a case where an amount of the supplying developer supplied from the supplying portion through a single supplying operation in the image forming operation is larger than the predetermined supplied amount and the amount of the developer in the developing device is a second amount which is larger than the first amount and smaller than the predetermined amount, the control portion is configured to interrupt the image forming operation and drive the conveyance portion for a second time shorter than the first time in a state that the image forming operation is interrupted.

* * * * *